United States Patent [19]

Conklin et al.

[11] Patent Number: 4,823,328

[45] Date of Patent: Apr. 18, 1989

[54] RADIO SIGNAL CONTROLLED DIGITAL CLOCK

[76] Inventors: Charles C. Conklin, 10371 N. Blaney Ave., Cupertino, Calif. 95014; Michael W. Faber, 833 Abbie St., Pleasanton, Calif. 94566; David Schachter, 801 Middlefield Rd.; Philip M. Spira, 2025 Tasso St., both of Palo Alto, Calif. 94301; Chi-Wen Wang, 1314 Shelby Creek La., San Jose, Calif. 95120; Paul L. Williams, 2200 Monroe St., No. 915, Santa Clara, Calif. 95050

[21] Appl. No.: 161,792

[22] Filed: Feb. 29, 1988

Related U.S. Application Data

[63] Continuation-in-part of Ser. No. 90,045, Aug. 27, 1987, abandoned.

[51] Int. Cl.[4] ..... G04C 11/02

[52] U.S. Cl. ..... 368/47

[58] Field of Search ..... 368/46, 47, 49, 51, 368/59

[56] References Cited

U.S. PATENT DOCUMENTS 4,117,661 10/1978 Bryant, Jr. .
4,440,501 3/1984 Schulz .
4,525,685 6/1985 Hesselberth et al. .
4,582,434 4/1986 Plangger et al. .
4,768,178 8/1988 Concklin et al. ..... 368/47

*Primary Examiner*—Bernard Roskoski
*Attorney, Agent, or Firm*—Flehr, Hohbach, Test, Albritton & Herbert

[57] ABSTRACT

A radio signal controlled clock which decodes time information in a radio signal and thereby determines the current time. The clock collects and stores radio signal data as soon as a reasonably decodeable radio signal is located, even before the minute boundary of the radio signal's time base has been located. This data is stored and later used for decoding and verifying the digits of the time information after the minute boundary has been located. In another aspect of the present invention, an internal counter in the clock is periodically resynchronized with the radio signal, and the average of the adjustments required for this resynchronization is maintained. When no radio signal is available, or the radio signal is too noisy to be reliably decoded, the average internal counter adjustment value is used to periodically adjust the internal counter—and thereby helps to keep the clock's internal counter as closely synchronized with the radio signal's time bases as possible when the radio signal is not available or not usable.

21 Claims, 5 Drawing Sheets

RADIO SIGNAL CONTROLLED DIGITAL CLOCK

This is a continuation-in-part of application Ser. No. 07/5090,045, filed on Aug. 27, 1987, now abandoned entitled IMPROVED RADIO SIGNAL CONTROLLED CLOCK.

This invention relates generally to a clock whose time output is based on a radio reference signal and more particularly to a clock that is continuously updated by a received radio reference timing signal.

BACKGROUND OF THE INVENTION

"Radio signal controlled clocks" are clocks which receive and decode time information broadcast on specified radio frequencies. These clocks provide a reliable time source that is known to be synchronized with other such clocks—and thus can be used to coordinate activities in various locations.

For example, traffic signal manufacturers can use radio signal controlled digital clocks to align traffic signals according to the time of day without having to connect all of the traffic signals to a single clock. Thus, a large number of similarly programmed, but not physically interconnected, traffic signals in a specified area can simultaneously, or in some other coordinated fashion, modify light intervals in accordance with the time of day.

In another example, computer services can use radio signal controlled digital clocks to coordinate the activities of computers in various locations.

The National Bureau of Standards has been broadcasting time information on standard frequencies for many years from stations in Ft. Collins, Colo. and Kauai, Hi. However, the signals are relatively weak and therefore are subject to noisy reception. Thus, radio signal controlled clocks may fail to lock on to the signal for long periods of time, or adopt an incorrect timebase.

The primary objective of this invention is to provide an inexpensive, highly accurate clock that is periodically updated by a received, broadcast time reference signal.

The present invention is an improved version of the OEM-10 radio controlled digital clock made by Precision Standard Time, Inc. of Fremont, Calif., as described in the patent application entitled High Precision Radio Signal Controlled Continuously Updated Digital Clock U.S. Pat. No. 4,768,178, filed Feb. 24, 1987, assigned to Precision Standard Time, Inc. U.S. Pat. No. 4,768,178 is incorporated by reference.

In particular, the present invention provides improved methods for correctly decoding broadcast time reference signals which contain noise, multipath signals, and/or fading signal levels, so that correct time information can be derived even if virtually every time reference signal is partially corrupted by noise. Using a stringent data verification algorithm would decrease the probability of decoding a bit in error, but would also decrease the probability of decoding it at all. Therefore, an objective herein is to reduce the probability of decoding errors to an acceptable minimum, while successfully deducing the correct time within a reasonable period.

Other features of the present invention include a method of determining the location of minute and second boundaries in the broadcast time reference signals using only a subset (i.e., the 100 Hertz component) of the NBS time signal, a method of collecting and making use of time data collected before the location of the minute boundaries has been determined, a method of searching for the best time reference signal (i.e., the best of several time signal carrier frequencies broadcast by NBS), and a method of providing a variable signal strength threshold which depends on the volume of noise in the received time reference signal.

SUMMARY OF THE INVENTION

In summary, the present invention is a radio signal controlled clock which decodes time information in a radio signal and thereby determines the current time. The present invention collects and stores radio signal data as soon as a reasonably decodeable radio signal is located, even before the minute boundary of the time base has been located. This data is stored and later used for decoding and verifying the digits of the time information after the minute boundary has been located.

In another aspect of the present invention, an internal counter in the clock is periodically resynchronized with the radio signal, and the average of the adjustments required for this resynchronization is maintained. When no radio signal is available, or the radio signal is too noisy to be reliably decoded, the average internal counter adjustment value is used to periodically adjust the internal counter—and thereby helps to keep the clock's internal counter as closely synchronized with the radio signal's time bases as possible when the radio signal is not available or not usable.

BRIEF DESCRIPTION OF THE DRAWINGS

Additional objects and features of the invention will be more readily apparent from the following detailed description and appended claims when taken in conjunction with the drawings, in which:

FIGS. 1 and 1A depict the format of each one minute frame of the NBS time signals.

DESCRIPTION OF THE PREFERRED EMBODIMENT

Additional Background Information

On the NBS Time Reference Signals

To understand the invention, it is first necessary to understand some of the details of the clock signal that is broadcast. The National Bureau of Standards (NBS) broadcasts continuous signals containing time, date and other information on high frequency radio stations WWV in Ft. Collins, Colo., and WWVH located in Hawaii. The radio frequencies used are 2.5, 5, 10, 15, and 20 Mhz. All of the NBS frequencies carry the same program, but because of changes in ionospheric conditions, different frequencies are more easily received at different times of the day. The time being broadcast is on the universal time scale also known as Coordinated Universal Time (UTC), formerly Greenwich Mean Time. This time scale is based on atomic clocks with corrections made for the rotational variations of the earth. The specific hour and minute transmitted in the broadcast and mentioned in the audio portion of the broadcast is that corresponding to the time zone centered around Greenwich, England. The UTC time differs from local time only by an integral number of hours in most countries including the United States of America. The UTC time announcements and transmissions are expressed in the 24 hour clock system, i.e. the hours are numbered beginning with zero hours at midnight through 12 hours at noon to 23 hours, 59 minutes just before the next midnight.

The National Bureau of Standards broadcast uses a carrier at 2.5, 5, 10, 15, and 20 Mhz with a 1000 Hz amplitude modulating tone burst to signal the beginning of each minute on Colorado station WWV, and a corresponding 1200 Hz amplitude modulating tone burst on Hawaii station WWVH. A 100 Hz subcarrier contains binary coded decimal (BCD) signals that supply day of the year, hour and minute information. Complete BCD information in the form of a frame is transmitted each minute.

Figure 1:
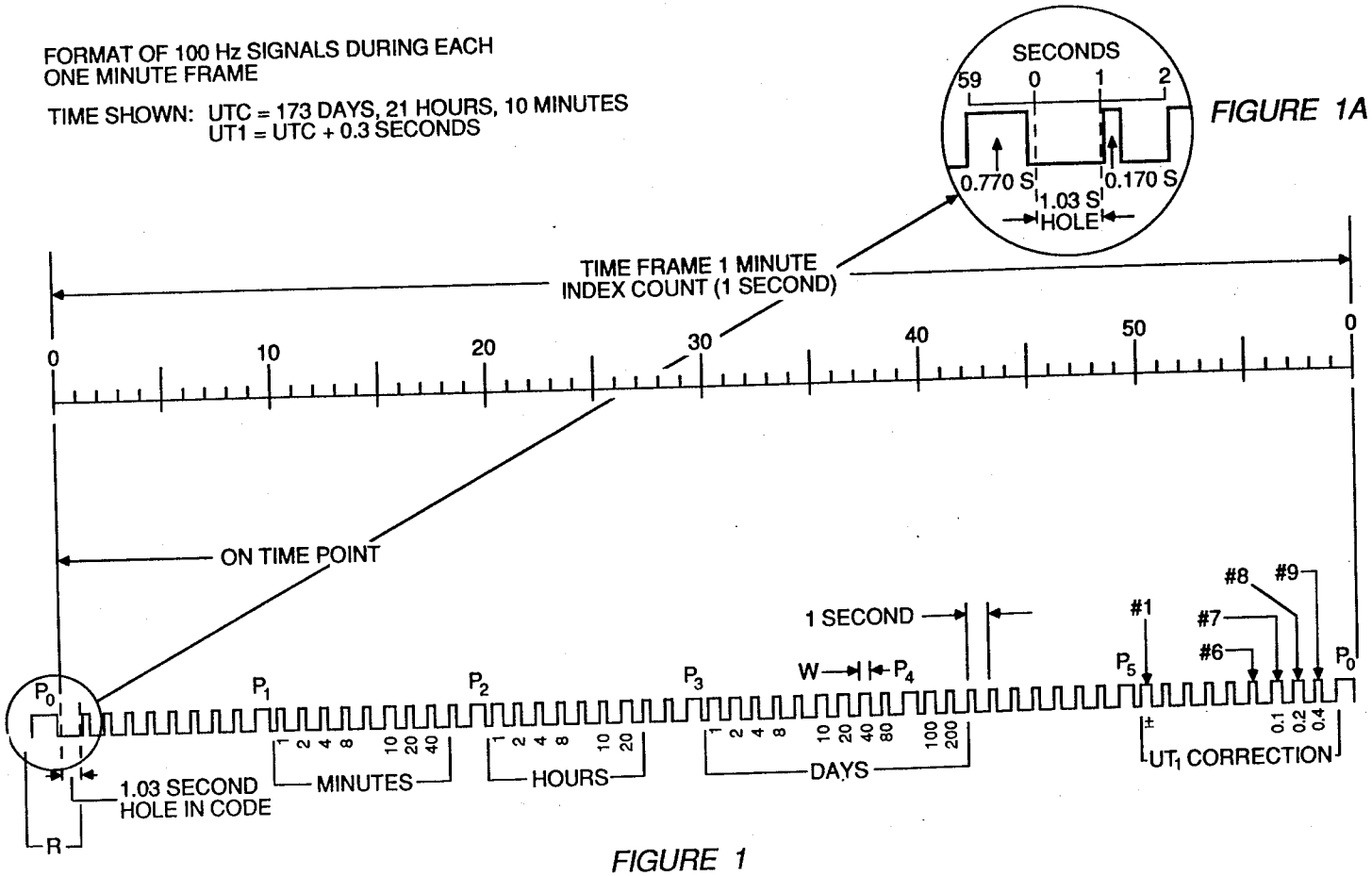

FIGS. 1 and 1A depict the format of each one minute frame of the NBS time signals. This information is encoded by pulse width modulation of the 100 Hz subcarrier. The data rate is one symbol per second, where each symbol is a 0, 1, or position marker. Within a time frame of one minute, enough pulses are transmitted to convey the current minute, hour and day of the year.

Table 1 shows the format of each one-second symbol, and Table 2 lists the information content of each of the sixty one-second symbol positions in each one minute frame.

TABLE 1

NBS ONE-BIT SIGNAL FORMAT

| Previous bit | Each Bit (length = 1 second), except 1st, 29th and 59th of each minute | | | |
|---|---|---|---|---|
| 0.200 silence | .005 1000 or 1200 Hz | 0.025 silence | 0.77 100 Hz for 0.00 to 0.77 sec | 0.200 silence |
| | 29th and 59th Bit every Minute | | | |
| 0.200 silence | 0.030 silence | 0.77 100 Hz for 0.77 sec | | 0.200 silence |
| | First Bit of every Minute, except first bit of each hour | | | |
| 0.200 silence | 0.800 1000 or 1200 Hz | | | 0.200 silence |
| | First Bit of every Hour | | | |
| 0.200 silence | 0.800 1500 Hz | | | 0.200 silence |

| Length of 100 Hz Tone | Information conveyed by bit |
|---|---|
| 0.00 second | Position Marker: first second of new frame |
| 0.17 | Binary value of 0 |
| 0.47 | Binary value of 1 |
| 0.77 | Decade markers at 9th, 19th, 29th, 39th, 49th, and 59th second of each minute |

TABLE 2

NBS TIME SIGNAL FRAME FORMAT

| Second(s) | Description of 100 Hertz Component of Signal |
|---|---|
| 0 | No pulse is transmitted at minute boundary |
| 1–8 | No information |
| 9 | P1 marker - 0.77 second pulse |
| 10–13 | Minutes, low order digit |
| 14 | No information |
| 15–17 | Minutes, high order digit |

TABLE 2-continued

NBS TIME SIGNAL FRAME FORMAT

| Second(s) | Description of 100 Hertz Component of Signal |
|---|---|
| 18 | No information |
| 19 | P2 marker - 0.77 second pulse |
| 20–23 | Hours, low order digit |
| 24 | No information |
| 25–26 | Hours, high order digit |
| 27–28 | No information |
| 29 | P3 marker - 0.77 second pulse |
| 30–33 | Days, low order digit |
| 34 | No information |
| 35–38 | Days, middle digit |
| 39 | P4 marker - 0.77 second pulse |
| 40–41 | Days, high order digit |
| 42–48 | No information |
| 49 | P5 marker - 0.77 second pulse |
| 50 | UT1 (leap second) correction = 0 if correction is negative, = 1 if correction is positive |
| 51–54 | No information |
| 55 | Control function #6 = 1 when Daylight Savings Time is in effect |
| 56–58 | Control function #7, #8 and #9, respectively, specify the amount of UT1 correction, specified as the number of tenths of leap seconds to be added or subtacted. |
| 59 | P0 marker - 0.77 second pulse |

Two BCD digits are needed to show the hour (00–23) and the minute (00–59), and three digits are needed to show the data (001–366). The time information is updated every minute. The BCD signals also have data providing a correction for periodic variations in the speed of the earth's rotation and information indicating whether daylight savings is in effect.

Clock Ticks. The most frequently transmitted signals on WWV and WWVH are clock reference pulses that mark the seconds of each minute (except the 29th and 59th second pulses of each minute, which are omitted completely), referred to hereafter as ticks. The first pulse of each hour is an 800 ms pulse of 1500 Hz. The first pulse of each minute is an 800 ms pulse of 1000 Hz (WWV) or 1200 Hz (WWVH). The remaining second pulses, or ticks, are brief audio bursts (5 ms pulses of 1000 Hz or 1200 Hz) that resemble the ticking of a clock. All pulses are commenced at the beginning of each second, and are given by means of double side band amplitude modulation. Each seconds pulse (or tick) is preceded by 10 ms of silence and followed by 25 ms of silence to avoid interference.

Leap Seconds. Because the earth's speed of rotation may vary, the use of leap seconds is occasionally necessary, perhaps once a year, to keep the broadcast time signals (UTC) within ±0.9 seconds of the earth related time scale. The addition or deletion of exactly one second occurs at the end of the month. Since the preferred embodiment of the invention has the capability of detecting leap seconds, a brief summary of t he meaning of leap seconds is disclosed herein. When a positive leap second is required, an additional second is inserted beginning at 23h 59m 60s of the last day of the month and ending at 0h 0m 0s of the first day of the following month. In this case, the last minute of the month in which there is a leap second contains 61 seconds. Assuming that unexpected large changes do not occur in the earth's rotation rate, it is likely that positive leap seconds will continue to be needed about once a year. If the earth should speed up, a negative leap second is deleted. In this case, the last minute of the month would have 59 seconds.

A more complete description of the signal format may be found in the National Bureau of Standards special publication 432, incorporated herein by reference. In this disclosure, reference is frequently made to Station WWV; however, this clock also receives Station WWVH, automatically selecting the first available signal of acceptable quality. Reference is also made to 1000 Hz, the WWV broadcast frequency; this clock also receives and samples the 1200 Hz signal of WWVH.

Clock Hardware

Figure 2:
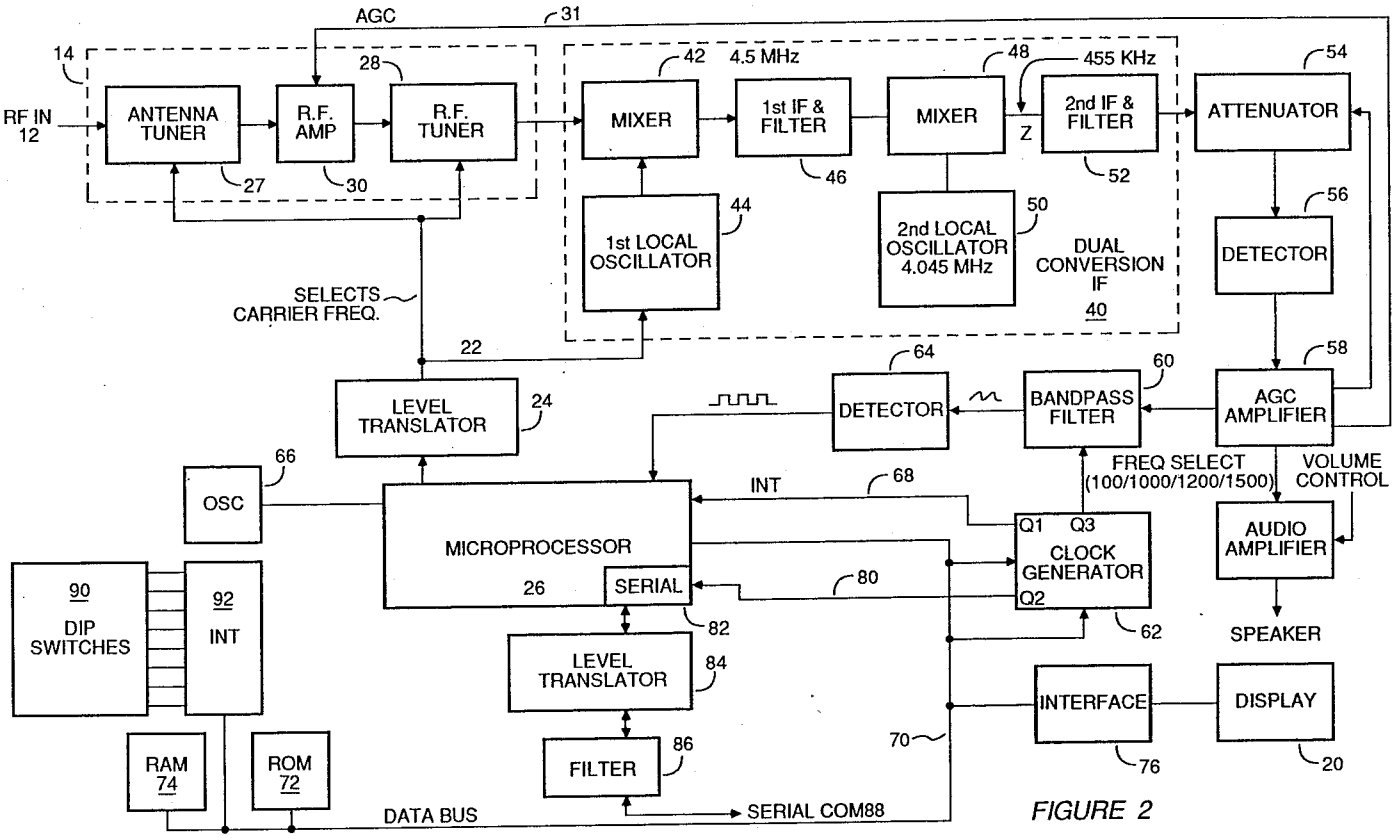
FIG. 2 is a block diagram of a radio signal controlled clock in accordance with the present invention.

Referring to FIG. 2, there is shown a block diagram of a radio signal controlled clock constructed in accordance with this invention. RF (radio frequency) signal 12, which includes the five NBS broadcast frequencies listed above, is received by an RF tuner 14 which is responsive to frequency band selection signals on line 22 sent by microprocessor 26 via a level translator 24. The microprocessor 26 is programmed to select one of the five NBS frequencies in accordance with a method described below.

In the preferred embodiment, the microprocessor 26, also herein called the CPU 26, is model 6303 microcontroller made by Hitachi. One important feature, described in more detail below, of this particular microprocessor is that it contains an internal CPU cycle counter that can be used as a timer for measuring periods of time with an accuracy of approximately one microsecond.

In the preferred embodiment the RF tuner 14 includes an antenna tuning circuit 27, followed by an RF amplifier 30 whose gain is controlled by an AGC (automatic gain control) signal on line 31, followed by an RF tuning circuit 28.

The output of the RF tuner 14 is passed to a dual conversion IF strip 40 of a standard design including a mixer 42 where the received signal is mixed with the output of a local oscillator 44 whose output is either 4.5 Mhz above or below the RF signal. The resulting 4.5 Mhz signal is passed through an IF and filter chip 46 to a second mixer stage 48 where the signal is mixed with the output of a second local oscillator 50 having an output signal at 4.05 Mhz. The second IF and ceramic bandlimiting filter chip 52 receives the resulting 455 KHz signal from mixer 48 and passes it to an attenuator 54.

The output of the dual conversion IF strip 40 is passed to an attenuator chip 54 to reduce the audio signal level so as to avoid distortion of the signal to be processed. Then the output of attenuator 54 goes to an audio signal envelope detector 56, which is a full wave rectifier, and the output of the detector 56 goes to an AGC amplifier 58.

DC elements of the output of the detector are used to define two AGC signals, one of which controls the attenuation produced by the attenuator 54, and another which controls the amplification by the RF amplifier 30. The output of the AGC amplifier (an audio signal in the range of 0–2 KHz) is applied to an audio bandpass filter 60 (e.g., a switched capacitive filter, such as the National MF8 filter), sometimes referred to herein as a subchannel filter. A controlling input to filter 60 comes from the output of a clock generator 62 which is in turn controlled by a microprocessor 26. Filter 60 is used to selectively interrogate the audio frequencies (i.e., 100, 1000, 1200 and 1500 Hertz) transmitted on WWV and WWVH. The frequencies are selected in a manner controlled by the software discussed below by microprocessor 26, and controlled through clock generator 62, the clock rate of which determines the selected center frequency to be passed by the bandpass filter 60.

The output of filter 60 is coupled to a threshold detector 64 (with hysteresis to prevent jitter) that detects the edges of the signal, provided they achieve a minimum amplitude. The detector 64 forms a square wave signal that can be processed by the microprocessor 26 to detect the existence of the frequency selected by the filter 60. The microprocessor has a real time input from the crystal oscillator 66, running at a relatively high frequency relative to the detected audio signal, and can be used to time the leading and trailing edges of the data signal.

The oscillator 66 operates at a rate of 6.144 MHz. The microprocessor 26 divides this rate by 4 to 1.536 MHz and feeds this latter signal to the clock generator 62. The microprocessor 26, also herein called the CPU, uses the 1.536 MHz signal as its basic internal clock, and thus is said to "perform at the rate of 1536 CPU cycles per millisecond."

The clock generator 62 has three programmable dividers, one of which normally divides the 1.536 MHz signal by 1536, resulting in a 1KHz interrupt signal on line 68 for the microprocessor 26. This interrupt signal is the internal timing source for the radio signal controlled clock, and is sometimes referred to herein as the system's heartbeat signal.

Since the crystal of the internal oscillator 66 may drift slightly from 6.144 MHz, it may be necessary to adjust the heartbeat signal in order to keep the internal timebase synchronized with the radio signal providing the time information. To do this, the divisor applied in clock generator 62 is modified to be 1535 or 1537 for a short initial portion of each minute, if required.

In addition the heartbeat signal allows the internal timebase of the clock to be maintained even if the radio signal is not available or not usable for a period of time.

A second output of the programmable clock generator 62 is fed to the microprocessor 26 as a baud rate generator for the serial output 82 (an RS232 port); and the third divider output supplies a square wave at one hundred times the desired center frequency of the bandpass (subchannel) filter 60 as alluded to above.

The timing data derived by the clock from the RF signal 12 is sent out from the microprocessor 26 over a data and address bus 70 which is also used to access the instructions stored in a ROM 72 and the data stored in a RAM 74. The digits to be displayed are transmitted via he data bus 70, through the interface (octal register) 76 to the display 20. Through the port 82 signals can be sent and received through a level translator 84 and filter 86 over a serial communications port 88.

Control of the bandpass filter 60—to switch between the 100 Hz, 1000 Hz, 1200 Hz and 1500 Hz frequencies in response to signals from clock generator 62—is essential to accurate time detection. As shown in FIG. 1, the start of each minute (except at the beginning of the hour) is conveyed by a 1000 Hz signal on WWV, and by a 1200 Hz signal on WWVH. Seconds boundaries are also indicated by a 1000 (or 1200) Hz tone of shorter duration. The minute, hour and day of year are conveyed by 100 Hz tones which do not overlap with the other tones. Thus the filter 60 (shown in FIG. 2) must be switched at appropriate times to receive all of these tones.

Finally, a set of DIP switches 90 provide a convenient means for users to select various options for configuring the clock system. The settings of these switches 90 are read by the microprocessor 26 via a standard bus interface circuit 92 that places signals corresponding to the switch positions onto the data bus 70 under control of the microprocessor 26.

Clock Software

The following is a detailed description of those aspects of the computer software used to control and run the radio signal controlled clock which are relevant to the present invention. Certain software routines, such as the software for controlling an LED display, the software for controlling an RS232 serial interface, the software for initializing the system's hardware, and the like use standard programming well known to those skilled in the art, and thus are described only in terms of their function rather in terms of their detailed implementation.

Reference should be made to FIGS. 1–4, and Appendices 1–8 while reading the following description. Appendices 1–8 contain pseudocode representations of the software subroutines relevant to the present invention.

TABLE 3

PSEUDOCODE APPENDICES

| APPENDIX | DESCRIPTION |
|---|---|
| 1 | HEARTBEAT/1 KHz INTERRUPT ROUTINE |
| 2 | INTERRUPT ROUTINE WHICH RESPONDS TO RISING EDGE OF SIGNAL AT SELECTED FREQUENCY |
| 3 | MAIN ROUTINE |
| 4 | DIGIT_VERIFY ROUTINE |
| 5 | TICK_ADJUST ROUTINE |
| 6 | AVERAGE_ADJUST ROUTINE |
| 7 | SEARCH_FREQ ROUTINE |
| 8 | MINUTE_FRAMING ROUTINE |
| 9 | START_UP ROUTINE |
| 10 | LOCKON_VERIFY ROUTINE |

The pseudocode used in these appendices is, essentially, a computer language using universal computer language conventions. While the pseudocode employed here has been invented solely for the purposes of this description, it is designed to be easily understandable to any computer programmer skilled in the art. The computer programs in the preferred embodiment are written primarily in the assembly language for the (Hitachi model 6303) microprocessor used therein.

The following are some notes on the syntax of this pseudocode:

Comments. Comments, i.e., nonexecutable statements, begin with "--". All text on the rest of that line, after a "--", is a comment.

Multiline Statements. Statements continue from line to line as needed.

If Statement. The syntax used is:

```
If - condition -                    optional comment
    - block of statements -         optional comment
Else                                optional comment
    - block of statements -         optional comment
Endif
or:
If - condition -                    optional comment
    - block of statements -         optional comment
Elseif - condition -                optional comment
    - block of statements -         optional comment
Endif
```

HEARTBEAT Interrupt Routine (Appendix 1). Referring to FIG. 2, the clock includes a clock generator 62 that generates an interrupt signal on line 68, herein called the Heartbeat interrupt signal, 1000 times per second. Each Heartbeat interrupt signal causes the system to run the analog signal input routine shown in Appendix 1.

The Heartbeat interrupt routine is a nonmaskable interrupt (i.e., it cannot be disabled) that generates several internal clock values which are used by other routines for controlling the timing of various tasks. In particular, this routine maintains several second counters:

SEC=internal seconds value between 0 and 59
S−1=internal seconds units digit
S−10=internal seconds decade digits and MINUTE and HOUR counters corresponding to the minute and hours of the internal timebase. This routine also updates several auxiliary counters, including CNT_1 which is updated once a minute and is equal to the amount of time since the most recent digit verification cycle began.

Clock Rate Adjustment. It is essential to the proper operation of the clock that the Heartbeat interrupt signal repeats once every millisecond, as precisely as possible. The problem is that the crystal oscillator 66 which controls the microprocessor 26 and provides the internal time base for the clock generator 62 can drift. In other words, while the oscillator 66 has a rated speed of 6.144 MHz, its actual speed will vary with temperature and age.

As described with reference to FIG. 2, the clock generator 62 contains a divider that generates one Heartbeat interrupt for every 1536 CPU cycles of the microprocessor 26.

The radio signal used to control the clock contains an extremely accurate 1 Hz "tick" signal that can be compared with the rate of the clock's oscillator. In particular, the internal clock called CNT_MAIN is initially synchronized with the tick signal—so that CNT_MAIN is equal to zero when the tick signal begins. Then, once each minute, the tick signal is compared with CNT_MAIN. This comparison is measured in terms of the number of CPU cycles by which CNT_MAIN has drifted from the tick signal.

If the internal oscillator 66 has become too fast, the CNT_MAIN will wrap around to zero before the tick signal is detected. If the oscillator 66 is too slow, CNT_MAIN will lag behind the tick signal. The rate of the Heartbeat signal is modified by changing the divisor in the clock generator 62 from 1536 to 1535 (if the oscillator is too slow) or 1537 (if the oscillator is too fast) for X milliseconds (i.e., X cycles of the CNT_MAIN internal counter), where X is the number of CPU cycles by which CNT_MAIN has drifted from the tick signal.

Synchronization of CNT_MAIN with the tick signal is described in more detail below, with reference to Appendices 3, 5 and 6.

RISING EDGE Interrupt Routine (Appendix 2). This routine simply stores two values whenever the bandpass filter 60 passes a signal with a rising edge of sufficient energy to pass through the signal detector 64. The rising edge of the signal emanating from the detector 64 initiates the execution of this interrupt routine. While this interrupt routine is maskable (i.e., this routine is not run when the interrupt mode is set to OFF), this is not essential to the present invention.

The two values stored by the routine are: (1) the current value of the CPU's cyclecounter is stored in a first register, herein called Store_CPU_Value, and (2)

a cycle counter called Store_100 HZ_Cycles is incremented. The cycle counter is used to determine the duration of the 100 Hz square waves the radio time signal, and is also used in the initial fine tuning of internal millisecond timer CNT_MAIN.

Figure 5:
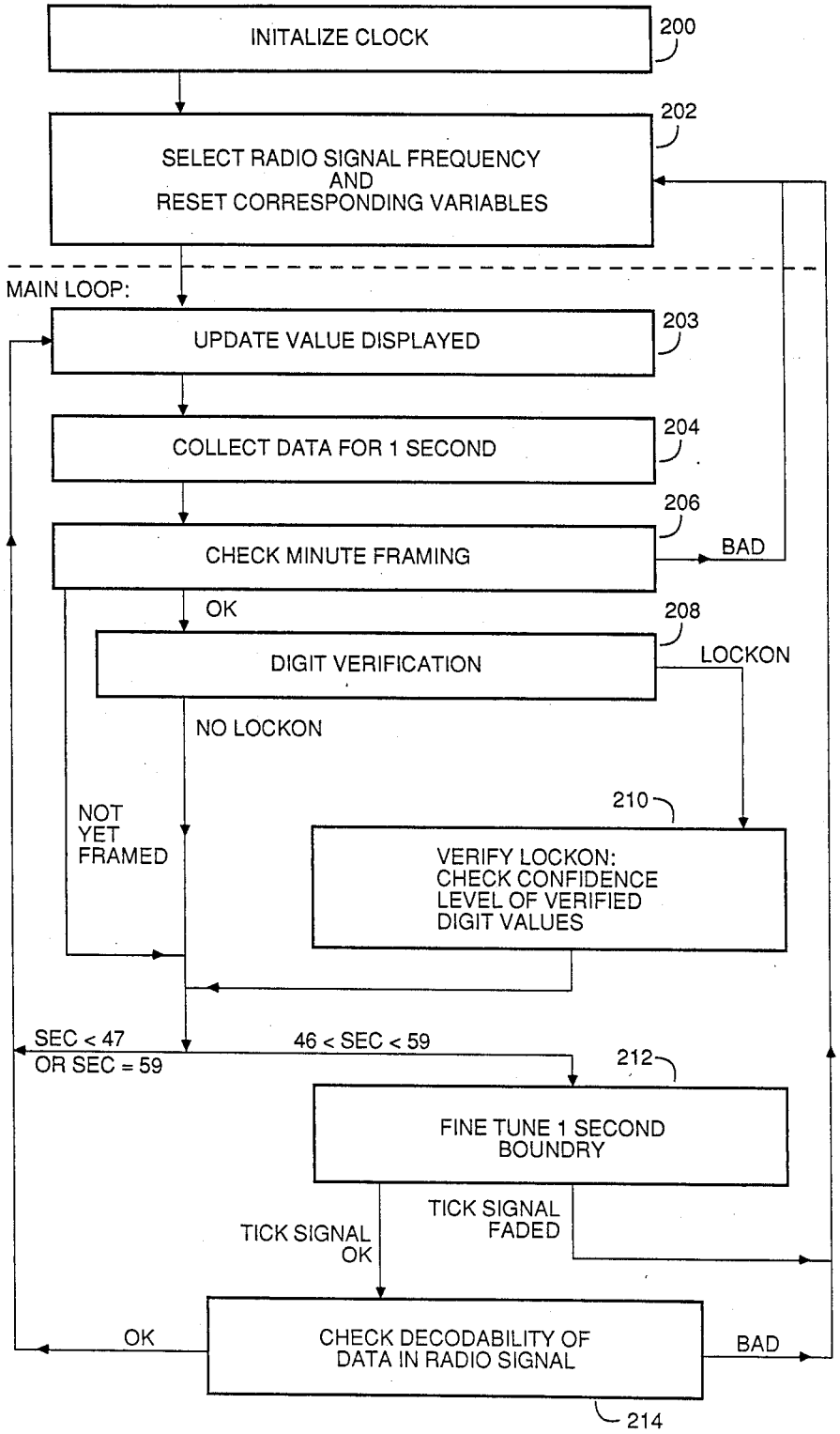
FIG. 5 depicts a flow chart of the process for decoding the time information contained in broadcast radio signals.

MAIN Routine (Appendix 3). Referring to FIG. 5, this procedure is used during normal operation, i.e., after a carrier frequency has been selected, and the initial fine tuning of the clock has been accomplished (boxes 200 and 202). Selection of a carrier frequency will be discussed below with reference to Appendix 7, and initial operation of the system after power up or a system reset is discussed below with reference to Appendix 9.

The MAIN routine runs continuously, one full loop per second, and processes the one bit of information contained in a single one second frame of the selected radio signal. See Table 1 for a list of the predefined signal formats used to encode each bit of information.

The first two steps of the main loop of the MAIN routine are to update the value being displayed by the clock (i.e., to transfer the internally generated clock value to the clock's display) (box 203), and to collect the radio signal data for one bit of data (box 204).

In general, the present invention uses only the 100 Hz component of the radio signal to determine the information content of each one second frame of the radio signal, and this one "bit of information" (i.e., symbol) in each one second frame can have only four different values. As shown in Table 1:

First second of each minute: no 100 Hz signal.

Decade Marker (see FIG. 1): 0.77 seconds of 100 Hz

Binary value of 0: 0.17 seconds of 100 Hz.

Binary value of 1: 0.47 seconds of 100 Hz.

Figure 3:
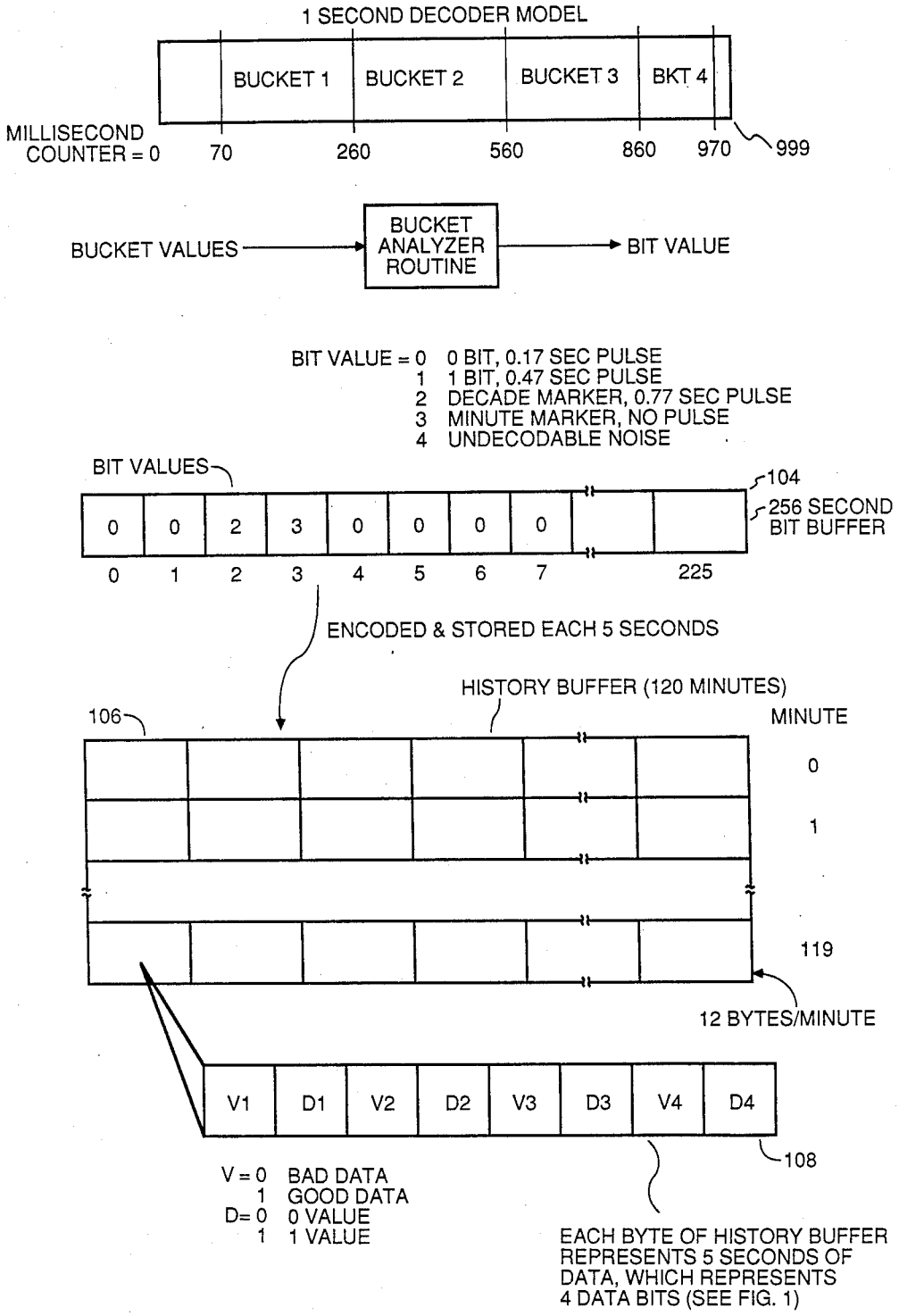
FIG. 3 is a data flow chart showing the data structures in which radio signal data is stored as it is decoded.

Referring to FIG. 3, the data bit is decoded by counting the number of 100 Hz cycles during each of four subsets of a one second time period. In FIG. 3 and Appendix 3 these four periods of time are called Buckets. The counting begins when the millisecond counter, CNT_MAIN equals 70, and ends when the CNT_MAIN equals 970. In the preferred embodiment, the count values in the four buckets are interpreted by a routine called BITVALUE as follows:

Minute Marker: all buckets have value $\leqq 2$.

Binary 0: Bucket $1>7$, all others $\leqq 2$.

Binary 1: Bucket $1>7$, Bucket $2>15$, Bucket $3\leqq 2$, Bucket $4\leqq 2$

Dec Market: Bucket $1>7$, Bucket $2>15$, Bucket $3>15$, Bucket $4\leqq 2$

Noise: Bucket $4>2$, and all otherwise undecoded bits (symbols)

The BITVALUE routine places the interpreted data into a circular buffer called the BIT BUFFER 104 which holds up to 256 seconds of data.

The next step of the main loop is to use the interpreted data from the BITVALUE routine for "minute framing" (box 206). "Minute framing" is the process of determining where each bit value received falls within the one minute signal frame shown in FIG. 1. While the minute framing process is described in more detail, in the section entitled "Minute Framing Routine", the basic method of the minute framing process is as follows.

The beginning of a new minute frame is denoted by a decade marker followed by a minute marker (i.e., one second with no 100 Hz signal). There are sixty possible locations of the minute marker. A 60-slot Minute Framing Buffer is used to accumulate scores for each possible location. When one location consistently looks like the minute marker, that position is denoted as the minute boundary and a flag called Minute_Framed is set to TRUE.

However, just in case the detected minute boundary is wrongly selected, due to an unusual noise pattern in the radio signal being received, new scores are continually added to the Minute Framing Buffer and re-evaluated. If the initially selected minute boundary is found to be incorrect, the clock calls the carrier signal selection routine so see if a better carrier frequency can be found (box 202).

Once the radio signal has been "minute framed", the process of trying to verify the received data (box 208) is begun. Note that all of the data accumulated in the BIT BUFFER before the framing of the minute boundary is saved for use in the data verification process. Once the minute boundary has been determined, all of the data stored in the BIT BUFFER 104 is loaded into a data structure called the HISTORY BUFFER 106 (see FIG. 3) using the placement of the minute boundary to determine the meaning of each data value stored in the BIT BUFFER. Thus, even if the data in the BIT BUFFER begins in the middle of a minute frame, it still can be used in the digit verification process.

The HISTORY BUFFER 106 is a circular buffer which can tore up to 120 minutes of radio signal data. As shown in FIG. 3, for each minute of data, the HISTORY BUFFER 106 contains twelve slots, each for storing five seconds of radio data. Thus the raw decoded radio data is stored at locations in the HISTORY BUFFER corresponding to the data's location in a one minute time frame (shown in FIG. 1)—which indicates how that data is to be interpreted.

Referring to FIGS. 1 and 3, note that each five seconds of radio data contains one second of "marker" or blank data, followed by up to four seconds of time information. As shown in FIG. 3, the data is compacted so that each five seconds is stored as a single byte of data 108 where each of the four seconds of data with time information is stored a two bits: a first bit which indicates if the radio signal data was bad or good (i.e., undecodeable or decodeable), and a second bit which is equal to the bit's decoded value.

During normal operation, the data in the BIT BUFFER 104 is processed once every five seconds by re-encoding the data and storing it in the HISTORY BUFFER 106, and then calling the DIGIT VERIFY routine (box 208 in FIG. 5) to interpret and verify this data. However, after the minutes digit has been verified the clock attempts to verify a new digit once each second, thereby decreasing the time it will take to verify all of the digits in the received radio signal.

After calling the DIGIT VERIFY routine, if all of the digits in the time signal have been verified, the clock is said to have "locked on" to the broadcast timebase. However, there is a very small chance that, in spite of all the precautions taken, that the "verified" timebase is incorrect. A special routine, herein called the LOCKON VERIFY routine (box 210 in FIG. 5) is used to determine when to accept the verified timebase, and how to deal with a verified timebase that is inconsistent with a previously verified timebase. The LOCKON VERIFY routine is discussed in more detail below with reference to Appendix 10.

The remaining portion of the MAIN routine is used, between seconds 47 and 58 of each minute, to adjust the internal millisecond counter CNT_MAIN so that it is as synchronized as possible with the clock tick in the radio signal (see box 212 in FIG. 5). Note that this portion of the MAIN routine is run between the 970th millisecond of each one second period, and the 70th millisecond of the next one second period.

The clock adjustment method will be discussed in more detail with reference to Appendices 5 and 6.

In addition, at this point in the MAIN ROUTINE, the routine checks (see boxes 212 and 214 in FIG. 5) to see if either the clock tick in the radio signal has faded or if the data in the radio has been undecodable for an extended period of time (e.g., 10 consecutive minutes). If so, MAIN ROUTINE calls the carrier signal selection routine (box 202 in FIG. 5) so see if a better carrier frequency can be found.

DIGIT VERIFICATION Routine (Appendix 4). The inventors have discovered that even if virtually every digit in the radio signal is partially corrupted by noise, it is still possible to accurately decode the time information in the radio signal with just a few minutes of data by decoding the data on a "bit by bit" basis, using the following method.

Figure 4:
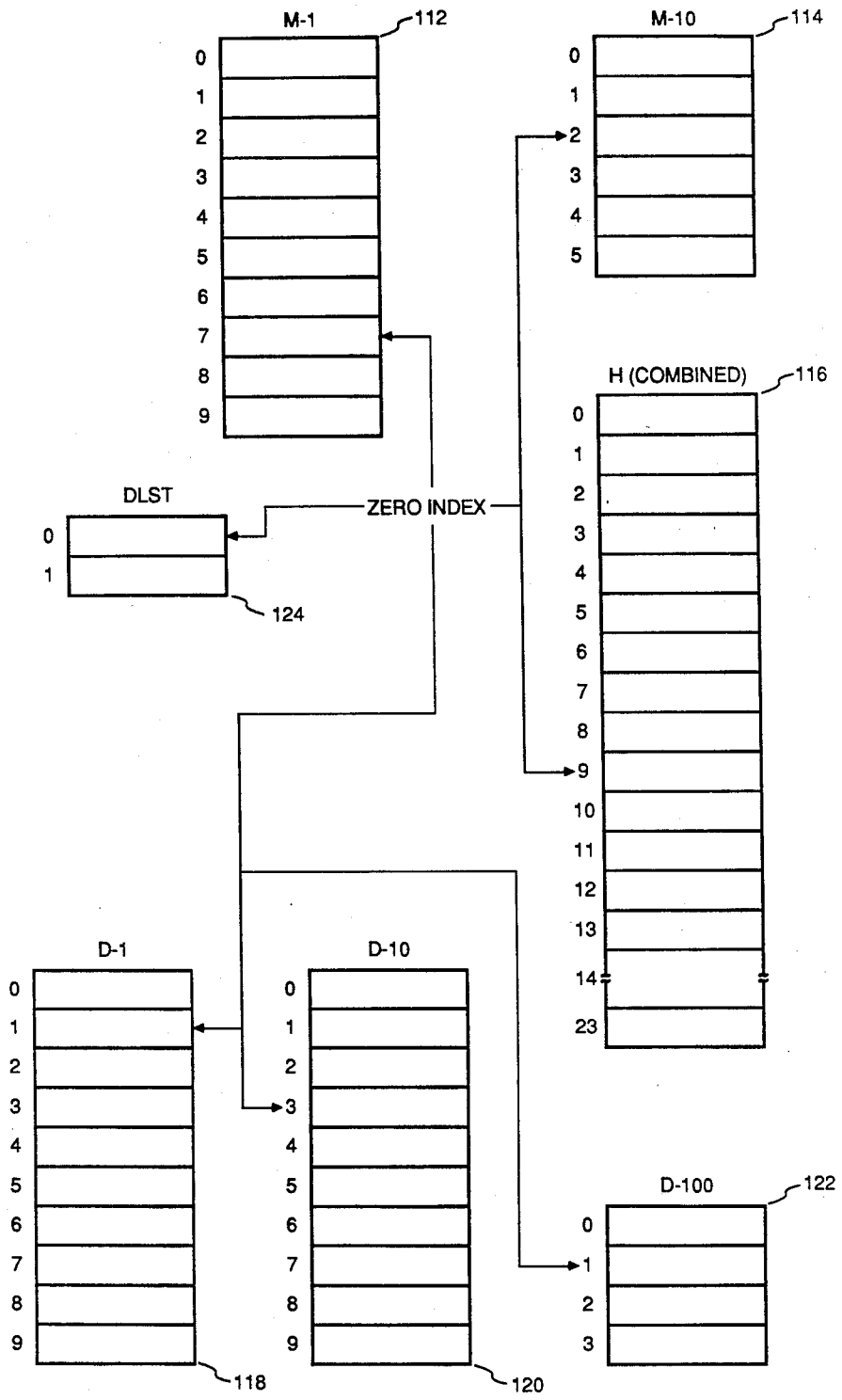
FIG. 4 depicts the data structures used for scoring hypothetical digit values during the data decoding process.

For each "value" to be decoded, such as the units digit of the minute value, there is provided a scoring or verification array 112–124, as shown in FIG. 4. The verification array contains one slot for every possible value of the selected digit or datum. Since the tens digit of the Days value can have ten different values, its array 120 has ten slots. The two digits for the Hours value have been combined, so the corresponding array has twenty-four slots (for values 0 through 23). The Daylight Savings bit can have only two values (0 or 1), and thus its digit verification array 124 has only two slots.

The basic "bit by bit" decoding method is to score each hypothetical value by incrementing each value in the digit verification array which is consistent with the value of the bit being decoded. Data bits which were undecodable are not scored. Also, data bits which look like position markers but are located where digit data should be, are not scored. Only received data which is stored in the HISTORY BUFFER as good data is scored.

Note that an important feature of the "bit by bit" decoding method is that the system can quickly recover from the effect of data bits which were improperly received - i.e., data bits interpreted as a 0 instead of a 1, or vice versa.

First Example. Taking D_10, the "days—tens" digit as an example, look at the "First Example of Digit Verification in Appendix 4). In this example, the data being carried by the radio signal is "0100", which represents a value of 2. However, the signal is noisy, and approximately one fourth of the bits have been corrupted. Bits which the system has determined are "undecodeable" are denoted with a value of 4. Bits which the system has interpreted as decodeable are denoted with their interpreted values: 0 and 1. However, both undecodeable bits and incorrectly decoded bits are denoted with an asterisk as an aid to using these charts.

The first row of the example assumes that this is the first data to be decoded, and that the verification array was cleared before the scoring process began. The first four bits of D_10 data contains three 0 bits, and one corrupted bit: 0400. The hypothetical value of 0 is given a score of 3 because three of the data bits are consistent with a value of 0. The hypothetical value of 1 is given a score of 2 because two of the data bits are consistent with a value of 1. The other hypothetical values are similarly scored.

For the moment, ignore the indication that "Zero_Index=0".

Next, the array is evaluated by finding the difference Δ between the value with the largest score and the value the next highest score. In this case Δ=0. If the value of the difference Δ equals or exceeds a specified threshold value, which typically has a value between 2 and 5, the value with the largest score is validated as being the proper value associated with the received data.

If the difference does not meet the specified threshold, the corresponding digit is not validated. As shown in this example, the next four bits of data: 0004 contains a "false zero". In any case, the scores for this data are added to the previous scores, and this process continues until the score for one value exceeds the next largest score by at least the specified threshold. In this particular example, it takes five minutes worth of data to determine and validate that the D_10 digit is equal to two (2).

Referring to FIG. 4 and the first page of Appendix 4, the data verification process is actually somewhat more complicated than shown in the first example. The complication is that the digits in the time value change over time. Thus, a digit that is now equal to 1 will eventually be equal to 2, and so on. To account for the progression of time, the verification arrays are used as circular buffers with the base of the array, called Zero_Index, being adjusted in conjunction with the passing of time.

In particular, each digit array's Zero_Index is decremented every X seconds, where X is the number of minutes between changes in the value of the digit. Also, the current value of X specifies the time at which the next less significant digit will roll over. Thus a Rollover counter is maintained for each type of digit to be verified (except for the minute-units digit, and the daylight savings indicator bit). The Rollover counters are each decremented once for each minute of radio signal data, as that data is processed. When a Rollover counter reaches zero the corresponding Zero_Index is moved one position in the digit verification array, and the Rollover counter cycles back to its maximum value.

Note that, because each digit changes in value at time which depends on the current value of the next less significant digit, each digit cannot be validated until the previous (i.e., next less significant) digit is validated.

When a set of data bits are scored, the scores are added to the slot specified by the sum of the Zero_Index and the raw data value, Modulo the number of values for the digit.

Second Example. The second example in Appendix 4 shows the operation of the Zero_Index for the minute-units digit. In this example, the Zero_Index is decremented, Modulo 10, once every minute. In the first minute the Zero_Index is equal to zero. Thus the score values are added to the slots for each hypothetical value.

In the second minute the Zero_Index has a value of 9, and the score values are added as follows:

SCORE=number of 0 and 1 bits consistent with Value

Store SCORE in Verifying Array at (ZeroIndex+Value) Modulo #Values

In this example, the data is validated in three or four minutes, depending on the threshold value used, even though every single minute of the data contains one bit of undecodable data. As shown by this example, as long as the noise in the radio signal leaves a reasonable amount of the 100 Hz data uncorrupted, then there is a very high probability that the time information will still be decoded properly with a relatively small number of minutes of data.

As shown in Appendix 4, a certain amount of care needs to be taken to adjust the Zero_Index values at the beginning of a new year. Also, the accumulated score values for the day-light savings indicator are limited to a small value so that changes in the status of this indicator can be properly decoded with a few minutes after its value in the radio signal has been changed.

After each digit is validated, a corresponding flag is set. When all of the digits have been validated a Time_Available flag and a Lockon flag are set—indicating that the clock has locked onto a validated time value. In addition, after the minute units digit has been validated, a flag called the Verify Mode flag is set to "off line", which tells the MAIN ROUTINE to try to verify a new digit every second until all the digits have been verified.

Variable Threshold. The value of the threshold used in the preferred embodiment increases as a function of the amount of time that the clock has been trying to verify the received data. The rationale for this is that if it takes a very long time to validate all of the digits, the radio signal must be poor in quality and a high threshold should be used to decrease the chances of validating an incorrect time value. In the preferred embodiment, the initial threshold value used is 2, and this value is increased by one every five minutes until the threshold reaches a value of 6.

Post Validation Operation. Once all of the time information has been validated, the digit verification process is restarted by clearing all of the digit verification arrays and then decoding new information from the radio signal. Also, each time the clock verifies all of the digits, the clock uses the Lockon_Verify routine (shown in Appendix 10) to determine if the newly verified digit values are consistent with previously verified digit values. Thus, if the radio signal information was improperly decoded, the Lockon_Verify routine will find that the decoded values are inconsistent with other verified values, and the incorrect digit values will be rejected. The Lockon_Verify routine is discussed in more detail below.

It should also be noted that the clock's internal counter continues to update the time even if the radio signal is lost and not recovered for a long period of time. The main problem with not having continued reception of the radio signal is that the clock value will eventually drift due to drift in the crystal oscillator's frequency. Also, the radio signal is needed for keeping up with leap seconds and changes in the daylight savings indicator.

INTERNAL CLOCK/TICK ADJUSTMENT Routine (Appendix 5). As alluded to above, the internal counters in the clock are adjusted once per minute so that they are synchronized with the tick signal (i.e., the 1000 or 1200 Hz signal) in the radio signal.

Referring to the MAIN routine (Appendix 3), the tick signal is sampled twelve times per minute, between seconds 47 and 58 of each minute, to adjust the internal millisecond counter CNT_MAIN. Note that this portion of the MAIN routine is run between the 970th millisecond of each one second period, and the 70th millisecond of the next one second period.

In particular, it is assumed that the CNT_MAIN counter has not drifted by more than 10 milliseconds or so. Thus, the system looks for the location of the tick signal inside a time window which begins at CNT_MAIN 980 and ends at CNT_MAIN 20 (i.e., twenty milliseconds before and after the beginning of a new second, using the clock's internal counter).

To locate the beginning edge of the tick signal, the bandpass filter 60 is set to 1000 Hz or 1200 Hz. Then, when CNT_MAIN=980, the CPU cycle counter in the CPU 26 is reset to zero. When, and if, the tick signal is first detected, the Interrupt Routine described in Appendix 2 will store the value of the CPU cycle counter into a register herein called Store_CPU_Value.

At CNT_MAIN 20, 20 milliseconds (30720 CPU cycles) are subtracted from the value in Store_CPU_Value, and the result is stored in the Tick Location array—an array which is used to store twelve such values collected during seconds 47 through 58 of each minute.

Twelve tick signals are sampled to increase the odds that at least a few of the values collected will be not significantly affected by noise. In the preferred embodiment, the system looks for four tick location values in the Tick Location array which are consistent with one another to within 1.05 milliseconds (1613 CPU cycles) and which vary from the current one second boundary by less than eight milliseconds (12288 CPU cycles). In other embodiments of the invention, the 1.05 milliseconds consistency requirement might be decreased to, say, 0.5 milliseconds and the maximum variance from the current one second boundary might be increased or decreased by several milliseconds.

If four such tick location values can be found, their values are averaged and the result is labelled ADJUST. The value of ADJUST is the number of CPU cycles by which the internal counter CNT_MAIN is ahead of or behind the observed tick signal. If ADJUST is positive, the internal counter is slowed down by one CPU cycle per millisecond for |ADJUST| milliseconds; if ADJUST is negative, the internal counter is sped up by one CPU cycle per millisecond for |ADJUST| milliseconds.

Since the Tick Adjust routine is run only once per minute, and there are 60,000 milliseconds in a minute, this method can adjust for all reasonable amounts of drift by the clock's oscillator 66.

If four consistent tick values cannot be found in the Tick Location array, this is indicative of a problem with the quality of the signal being received. A counter called the BadTick_Cycles counter is used to count the number of consecutive minutes in which the tick signals are so poor that a tick adjustment cannot be performed. If this condition persists continuously for a predefined period of time, such as ten minutes, the SearchFreq routine is called (by the Main routine) to try to find a better signal frequency.

AVERAGE CLOCK DRIFT ADJUSTMENT Routine (Appendix 6). Another important aspect of the process of keeping the 0 internal counter CNT_MAIN synchronized with the radio signal, is to keep track of the average drift of the CNT_MAIN counter. Thus, every time the Tick Adjust routine adjusts the internal counter (see Appendix 5), the value of the adjustment is passed to the AVERAGE_ADJUST routine. This long term drift tracking routine works as follows.

The routine maintains four clock adjustment accumulators: two current values, and two successor values. One set of values is kept for tracking the 1000 Hz tick signals, and another set is kept for tracking the 1200 Hz tick signals. Each accumulated adjustment value comprises two components: (1) the accumulated or net clock adjustment, in units of CPU clock cycles, and (2) length of time over which the adjustment has been accumulated.

The reason separate values are kept for the 1000 Hz and 1200 Hz tick signals is that these signals are broadcast from different locations (Fort Collins, Colo. and Kauai, Hi.) and each clock can be located different distances from these two broadcast locations. In some cases, the timing difference between the 1000 and 1200 Hz signals can be as much as 10 milliseconds.

Every minute, when an adjustment value is passed to this routine, the passing routine indicates which tick frequency was used, and also indicates whether the tick signal was of sufficient quality to be usable for adjusting the internal counter CNT_MAIN. The adjustment value is added to both the Current and Successor adjustment values for the specified tick frequency, and the corresponding time values are incremented. Furthermore, if the adjustment accumulators for the other tick frequency are already in use (i.e., have nonzero values), then the adjustment value is also added to these accumulators.

The AVERAGE_ADJUST routine computes an average clock adjustment value, called LONG_ADJUST, whenever the tick signal for the current minute's data was of sufficient quality to be the tick signal is not usable, the system uses the LONG_ADJUST value to adjust the internal counter's clock rate. Thus, if the internal counter has consistently needed to be sped up or slowed down, this average clock drift adjustment method will keep the internal clock in reasonably close synchronization with the radio signal's tick, even when the radio signal is to noisy to be usable for this purpose.

It should be noted that if the LONG_ADJUST value is calculated using the Current accumulator for the tick frequency currently being used by the system.

Periodically, Which may be anywhere from once every other day to several times a day, the "Successor" accumulator values are copied into the Current"accumulators, and the Successor" accumulator values are set to zero. This transfer only happens when the Tick Adjust routine indicates that a good radio signal was received and that the internal counter has been adjusted in accordance with the received signal. The use of the Successor and Current accumulators assures that the LONG_ADJUST values represent a fairly long term average clock drift value.

FREQUENCY SEARCHING Routine (Appendix 7). This routine is used to select a carrier frequency from the list of available frequencies. The first step in this routine is to reset all of the internal variables used for digit verification, minute framing, and for detecting faded tick signals or consistently undecodable data.

After the internal variables have been reset, all of the available carrier frequencies are scored on the basis of the quality of the 100 Hz signal component of each carrier, and the order of the carrier frequencies in the list is rearranged with the highest scoring frequencies at the top of the list.

Then, starting at the top of the list of available frequencies, a carrier frequency is selected and subjected to two tests: one which evaluates the 100 Hz component of this carrier frequency, and a second one which evaluates the tick (i.e., 1000 or 1200 Hz) signal component. A carrier frequency must pass both tests, otherwise the routine selects and tests the next frequency in the list of available frequencies.

The 100 Hz signal is evaluated, both for initial quality scoring purposes, and also for carrier frequency selection, as follows. The 100 Hz signal is "integrated" over a short period of time, such as four seconds. Using one hundred integration buckets, BUCKET_100 HZ(0 to 99), representing each 10 millisecond portion of a one second period of time, the number of 100 Hz cycles in each 10 millisecond time slot is integrated or accumulated over a short period of time, such as four seconds. If the 100 Hz signal does not yield a reasonably clear rising edge, the routine selects the next carrier frequency in the list of available frequencies, and reruns the 100 Hz evaluation test.

The quality of the rising edge is scored by calculating the correlation of the BUCKET_100 HZ data with an ideal rising edge. Every time that the 100 Hz component of a carrier frequency is tested, its current correlation score is used to determine the placement of the carrier frequency in the list of available frequencies—so that the frequencies with the best reception will be tested first.

If the rising edge of a square wave is clearly discernible from the integration buckets (i.e., if there is a strong correlation between an ideal square wave and the collected data), then the process continues by looking at the quality of the one second tick signals in the selected carrier frequency.

The tick signals are evaluated in a similar fashion, except that the integration is performed using 128 one millisecond time slots centered at thirty milliseconds before the rising edge of the 100 Hz signal (labelled ZeroLctn in Appendix 7). Also, the integration is typically performed for a somewhat longer period of time, such as ten seconds. Note that the tick signals each have a duration of only 5 milliseconds. Therefore, if the clock is receiving a good tick signal, at least four and no more than six of the integration buckets should have a value significantly greater than zero.

If the first one of the two tick frequencies (e.g., 1000 Hz) does not pass this test, then the second tick frequency is evaluated. If neither pass the test, the routine selects a new carrier frequency and reruns the frequency evaluation tests.

If a tick frequency does pass this integration test, then it is denoted as the TICK TYPE, and the internal millisecond counter CNT_MAIN is synchronized with first rising edge of the tick signal.

The last step of the frequency searching routine is to reset the CNT_1 counter, which is used to vary the digit verification threshold used by the DIGIT VERIFY routine.

Note that even after the clock has been running for some time, it may lose reception of the radio signal and need to search for a new radio carrier frequency. Thus, if this is not the first time the clock has performed a frequency search, the long term clock drift routine (see Appendix 6) will be in operation, and the adjustment of the internal millisecond counter must be passed to that routine so that it can keep track of the clock drift during the period of time that the system was searching for a new carrier frequency.

MINUTE FRAMING Routine (Appendix 8). "Minute framing" is the process of determining where each bit value received falls within the one minute signal frame shown in FIG. 1.

The beginning of a new minute frame is denoted by a decade marker followed by a minute marker i.e., one second with no 100 Hz signal). There are sixty possible locations of the minute marker. Therefore a 60-slot Minute Framing Buffer is used to accumulate scores for each possible location.

In particular, all the slots of the Minute Framing Buffer (MFB) are initially set to a value of 40 hex. When a decade marker is followed by a minute marker (i.e., no 100 Hz signal for one second), the corresponding slot in the MFB is incremented. When a decade marker is followed by a data value of 0 or 1, the corresponding slot in the MFB is decremented, but not below zero.

When the slot in the MFB with the highest value has a value that is at least two more than the slot with the next highest value, the slot with the highest value corresponds with the minute boundary and a flag called Minute Framed is set to TRUE. Furthermore, the clock's internal counter is synchronized with this minute boundary.

However, just in case the detected minute boundary is wrongly selected, due to an unusual noise pattern in the radio signal being received, new scores are continually added to the Minute Framing Buffer and re-evaluated. If the initially selected minute boundary is wrong, the value in another slot of the MFB will eventually attain a value equal to or greater than the value in the MFB slot for the selected minute boundary. In the unlikely case that this happens, a flag called Minute Faded is set to TRUE and the clock calls the carrier signal selection routine so see if a better carrier frequency can be found.

START UP Routine (Appendix 9). When the system is first powered up or reset the computer performs the usual self diagnostic tests. Then it initializes the internal clock counters, and the long term clock drift arrays used by the drift adjustment routine (i.e., the AVERAGE ADJUST routine shown in Appendix 6).

The next step is to call the frequency search routine to find a radio carrier frequency. The frequency search routine also initially synchronizes the internal clock counters with the radio signal's one second time base. Note that this initialization does not determine the location of minute boundaries—i.e., does not determine the current value of the seconds portion of the current time value.

The last step of the start up procedure is to call the Main Routine.

LOCKON VERIFICATION Routine (Appendix 10). Once all of the time information has been validated by the DIGIT VERIFY routine, the LOCKON VERIFICATION routine is called to check the newly verified digit values with previously verified digit values. The primary purpose of the LOCK VERIFICATION routine is to prevent the clock's "output timebase" from being replaced with an erroneously verified time value.

This routine uses several variables for keeping track of the time values verified during each "lockon". GuessTimebase is the time value from the last lockon. OutputTimebase is the current value of the clock's internal timebase, and is also the timebase value which the clock shows to the outside world. In addition, there is an AlternateTimebase which is denotes any verified timebase value that is inconsistent with the OutputTimebase.

A confidence level variable C_OUT is associated with a the OutputTimebase, and C_ALT is the confidence level variable for the AlternateTimebase. In addition, there is a predefined maximum value Cmax (e.g., Cmax is equal to 8 in the preferred embodiment) for the confidence level variables. As will be understood by studying the LOCKON VERIFICATION routine shown in Appendix 10, Cmax need be only large enough to make the probability of replacing the OutputTimebase with an incorrect value vanishingly small.

Finally, there is a drift rate value MaxDriftRate which corresponds to the maximum drift rate of the clock's internal counters in the absence of a useable radio signal. Generally, this value should be somewhat greater than the actual maximum drift rate of the clock, and it is set to about 10 seconds per day in the preferred embodiment.

When this routine is called, the newly verified time value is stored in a variable called the Guess Timebase. Furthermore, all of the digit verification variables are cleared so that the digit verification process can start anew after the completion of this routine.

If this is the first time that the clock has "locked on" to the radio signal since being turned on or reset, the GuessTimebase is copied into the OutputTimebase, and the confidence level C_OUT for the OutputTimebase is set equal to 1.

Thereafter, each time that the clock locks onto a timebase value, this GuessTimebase is checked for consistency with the OutputTimebase. In particular, the difference between the GuessTimebase and the OutputTimebase is compared with the maximum amount that the internal clock could have drifted since the last time that the value of the OutputTimebase was confirmed (i.e., found to be consistent with a GuessTimebase). If this difference is less than the maximum possible drift, the OutputTimebase is replaced with the GuessTimebase, and the confidence level C_OUT of the OutputTimebase is incremented (but not above Cmax).

If the difference between the GuessTimebase and the Output-Timebase exceeds the maximum possible drift, then the GuessTimebase is compared with the AlternateTimebase.

If there is no previous AlternateTimebase, the AlternateTimebase is set equal to the GuessTimebase and its confidence level C_ALT is set to 1.

If there is a previous AlternateTimebase, the difference between the GuessTimebase and the AlternateTimebase is compared with the maximum amount that the internal clock could have drifted since the last time that the value of the AlternateTimebase was confirmed (i.e., found to be consistent with a GuessTimebase). If this difference is less than the maximum possible drift, the confidence level C_ALT of the AlternateTimebase is incremented (but not above Cmax).

Furthermore, if the increased C_ALT value is greater than or equal to the confidence level C_OUT of the OutputTimebase, this means that the OutputTimebase is probably incorrect and therefore the OutputTimebase is replaced with the GuessTimebase value. If increased C_ALT value is not greater than C_OUT, the AlternateTimebase is replaced with the GuessTimebase and the routine returns to the MAIN routine.

If the difference between the GuessTimebase and the AlternateTimebase is greater than the maximum possible drift, the GuessTimebase disagrees with both the OutputTimebase and the AlternateTimebase. In this case, the confidence level C_ALT of the Alternate Timebase is decremented, and if the resulting C_ALT value is zero, the AlternateTimebase is replaced with the GuessTimebase and C_ALT is set equal to 1.

In summary, the LOCKON VERIFICATION routine allows the current Output Timebase to be replaced with a newly verified timebase value only if the new value is consistent with the current Output Timebase value, or if the new value has been more consistently verified than the Output Timebase value.

Alternate Embodiments of the Present Invention In one variation of the preferred embodiment, the detector 64 (FIG. 2) in the preferred embodiment could be replaced with an analog to digital converter (ADC). As will be understood by those skilled in the art, the output of the ADC could be processed in a number of different ways to derive timing information regarding the pulse (100 Hz) and clock reference (1000/1200 Hz) components of the time-based radio signals.

In another variation of the preferred embodiment, the clock could include temperature measurement apparatus (such as a thermocouple) and corresponding software for correlating the average drift of the clock's internal counters with the measured temperature. Since the clock's internal oscillator's rate will generally vary with temperature, this variation of the average clock drift feature in the present invention may provide better clock drift prediction for applications with large temperature variations during short periods of time.

It should also be noted that many aspects and features of the present invention are applicable to the interpretation and decoding of many types of encoded time reference signals in addition to the NBS time-based radio signals used by the preferred embodiment. For example, the described mechanism for resynchronizing an internal counter with a time reference signal, for keeping track of the average drift of the internal counter, and then using that average drift to "trim" the internal counter between resynchronizations, could be advantageously used in a wide variety of clock systems.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

APPENDIX 1

PSEUDOCODE FOR HEARTBEAT / 1 KHz INTERRUPT ROUTINE

```
-- This routine updates all internal clock counters.

-- CNT_MAIN    is the millisecond clock use to determine
--             position within a one second time frame
-- CNT_1  is an internal clock, incremented once a minute,
--        used to control the digit verification threshold
-- CNT_2  is an auxiliary millisecond clock

--  S_1        = internal seconds units digit
--  S_10       = internal seconds decade digit
--  SEC        = internal seconds clock
--  MINUTE     = internal minute  clock/value
--  HOUR       = internal hour    clock/value

CNT_MAIN = CNT_MAIN + 1  Modulo  1000
CNT_2 = CNT_2 + 1              --  auxiliary millisecond
clock

If CNT_MAIN = 0
     SEC = SEC + 1 Modulo 60
     S_1 = S_1 + 1 Modulo 10
     If S_1 = 0
          S_10 = S_10 + 1  Modulo 6
          If S_10 = 0
               Increment CNT_1
               MINUTE = MINUTE + 1  Modulo 60
               If MINUTE = 0
                    HOUR = HOUR + 1  Modulo 24
                    If HOUR = 0
                         CALL NEWDAY    -- Check for New Year
                    Endif                -- etc.
```

```
                Endif
            Endif
        Endif
Endif

If ADJUSTflag                    -- Monitor Period during which

     ADJUST = ADJUST - 1         -- Clockrate has been modified
     If ADJUST ≤ 0
          Set ClockRate = 1536       -- Go back to normal
          ADJUSTflag = .F.           -- clockrate
     Endif
Endif

Return
```

APPENDIX 2

PSEUDOCODE FOR INTERRUPT ROUTINE
WHICH RESPONDS TO RISING EDGE OF SIGNAL
AT SELECTED FREQUENCY

```
--  For Fine Tuning of Second Boundary, the number of CPU
--  cycles, starting at 980 milliseconds, is counted until
--  the beginning of edge of the next clock tick (at 1000
--  or 1200 Hz.
--  - See MAIN ROUTINE, Appendix 3, at 980 milliseconds

If Store_CPU_Value = 0
     Store_CPU_Value = CPU_Cyclecounter
Endif


--  For data bit decoding, the number of 100 Hz cycles is
--  counted during each of four periods of time
--  - See MAIN ROUTINE, Appendix 3, at 70 milliseconds.

--  For initial fine tuning of the location of the one
--  second boundary, the following counter is also used to
--  detect the location of the 1000 or 1200 HZ clock tick.
--  - See SEARCH_FREQ ROUTINE, Appendix 7

Store_100HZ_Cycles = Store_100HZ_Cycles + 1

Return
```

APPENDIX 3

PSEUDOCODE FOR MAIN ROUTINE

```
-- The following procedure is used during normal operation,
-- - i.e., after a carrier frequency has been selected, a
-- tick frequency (1000 Hz or 1200 Hz) has been selected,
-- and the initial fine tuning of the clock has been
-- accomplished.

-- See STARTUP ROUTINE, Appendix 9, for initialization
-- of the clock upon power up or reset.

DO WHILE = .T.                    -- One Loop per second

Call DISPLAY_UPDATE               -- Update Value being displayed
                                  -- once each second

-- For data bit decoding, the number of 100 Hz cycles is
-- counted during each of four periods of time:
```

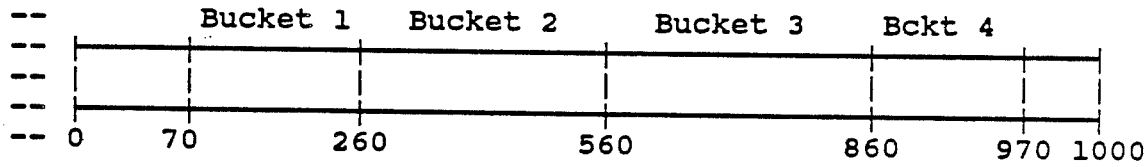

```
Set Subchannel Tuner to 100 HZ
Interrupt_Mode = HZ_COUNT          -- Prepare to count
                                   -- 100 HZ cycles

Wait until CNT_MAIN = 70
Store_100HZ_Cycles  = 0

Wait until CNT_MAIN = 260          -- Collect 100 HZ data
Bucket_1 = Store_100HZ_Cycles      -- for each of the four
Store_100HZ_Cycles  = 0            -- buckets

Wait until CNT_MAIN = 560
Bucket_2 = Store_100HZ_Cycles
Store_100HZ_Cycles  = 0

Wait until CNT_MAIN = 860
Bucket_3 = Store_100HZ_Cycles
Store_100HZ_Cycles  = 0

Wait until CNT_MAIN = 970
Bucket_4 = Store_100HZ_Cycles

Call BITVALUE          -- Calculates bit value, based on bucket
                       -- data, and stores result in Bit Buffer
-------   Check Minute Framing
```

```
If Previous_Bitvalue  = Decade Marker
    Call Minute_Framing                -- See Appendix 10
    If Minute_Faded = .T.
        Call SearchFreq                -- See Appendix 7
    Endif
Endif

Previous_Bitvalue = Current_Bitvalue

--  If Minute Boundary is not Framed within Ten Minutes of
--  selecting a new frequency, select a new frequency

If .NOT. Minute_Framed  .AND. CNT_1 ≥ 10
    Call SearchFreq
Endif

-------   Digit Verification

--  Normally, once every five seconds, the bit values from
--  the last five seconds are stored in the history buffer
--  and processed by the Digit Verification routine.

--  When the Minute/Unit digit has been verified, but at
--  least one other digit has not yet been verified, try to
--  verify a new digit once each second

If Minute_Framed = .T.          --  Verify only after Minute
                                --  boundaries are framed

    If  S_1 = 4 .OR. S_1 = 9

        CALL HISTORY_VALUE          --  Put data for last 5
                                --  seconds into history buffer

        Digit_Type = Integer(S_1 /5) + ( 2 * S_10 )
        Call DIGIT_VERIFY

    ElseIf Verify_Mode = Off_Line

    -- Digit_Types are Verified in order of significance:
    -- M_1, then, in order, M_10, H, D_1, D_10, D_100, DLS

        Digit_Type = Next Digit_Type to be Verified
        Call DIGIT_VERIFY               --  See Appendix 4
    Endif
Endif
--  If all Digits have been Verified, Check Confidence
--  Level of Newly Verified Digit Values before deciding
--  to use these digit values as the Output Timebase

If Lockon
    Call LOCKON_VERIFY          --  See Appendix 9
Endif

--  Clock Adjustment for Maintaining Proper 1 Sec Boundary
```

```
--  Calculate deviation of the observed one second boundary
--  (using the 1000 or 1200 Hz tick) from the current one
--  second boundary.  The deviation is measured in units of
--  CPU cycles, with 1536 (600 HEX) CPU cycles in each
--  millisecond.

--  TICK_LOCATION ARRAY - for storing location of
--                      - 12 consecutive Ticks
--
--   1   2   3   4   5   6   7   8   9  10  11  12
--
--  |   |   |   |   |   |   |   |   |   |   |   |
--
--
--  Procedure: Wait until 980 milliseconds. Start CPU
--  cyclecounter.  Store cyclecounter value upon detecting
--  first rising edge of tick (see Appendix 2).  Cyclecount
--  value is adjusted by 20 milliseconds (30720 cpu cycles)
--  so that stored value is zero if clock has not drifted.

If SEC ≥ 47 .AND. SEC ≤ 58
    Set Subchannel Tuner to TICK_TYPE    -- 1000 or 1200 HZ
    Store_CPU_Value = 0          -- prepare store register
    Wait until CNT_MAIN = 980
    Clear CPU's CPU_Cyclecounter         -- unitary operation

    Wait until CNT_MAIN = 20
    TICK_LOCATION(SEC-46) = Store_CPU_Value - 30720
Endif

--  Check for fading of Tick Signal.
--  If the Tick Signal remains faded for at least
--  10 consecutive minutes, look for a better signal.

If SEC = 58
    Call Tick_Adjust     -- See Appendix 5.  Adjusts
                         -- location of one second boundary
    If BadTick_Cycles ≥ 10
        Call SearchFreq --  See Appendix 7
    Endif
--  Check for noisy radio signal.  Initiate search for
--  better radio signal only if bad data (at least 26 bits
--  of undecodable data in each one minute frame) is
--  received during 15 consecutive minutes.

    If Badbits > 25
        Increment Badbit_Cycles
        If Badbit_Cycles ≥ 15
            Call SearchFreq --  See Appendix 7
        Endif
    Else
        Badbit_Cycles = 0
    Endif

Endif

EndLoop
```

APPENDIX 4

PSEUDOCODE FOR DIGIT_VERIFY ROUTINE

-- Verifies, on a bit by bit basis, one digit or data type

Parameter Data Structure for Digit_Types

| -- Digit Type Value | Zero_ Index | #Values | max Rollover_Time | current Rollover_Time | Start_ Ptr | End_Ptr | Digit Name: |
|---|---|---|---|---|---|---|---|
| 0 | 0 | 0 | 0 | 0 | 0 | 0 | not used |
| 1 | 0 | 0 | 0 | 0 | 0 | 0 | not used |
| 2 | | 10 | 1 | 1 | | | Minute - 1's |
| 3 | | 6 | 10 | 9 | | | Minute - 10's |
| 4 | 0 | 0 | 0 | 0 | 0 | 0 | not used |
| 5 | | 24 | 60 | 59 | | | Hours 0-23 |
| 6 | | 10 | 1440 | 1440 | | | Days - units |
| 7 | | 10 | 14400 | 14400 | | | Days - 10's |
| 8 | | 4 | 100 | 100 | | | Days - 100's |
| 9 | 0 | 0 | 0 | 0 | 0 | 0 | not used |
| 10 | 0 | 0 | 0 | 0 | 0 | 0 | not used/UT1 |
| 11 | | 2 | 0 | 0 | | | Daylight Savings |

```
--      Variable Digit Verification Threshold:
--           Threshold value varies as a function of the amount
--           of time, CNT_1, since the beginning of a new
--           digit verification cycle or phase.
```

| -- Threshold value: | 2 | 3 | 4 | 5 | 6 |
|---|---|---|---|---|---|
| -- CNT_1: | ≤ 5 | ≤ 10 | ≤ 20 | ≤ 30 | > 30 minutes |

```
If Digit_Type = 0, 1, 4, 9, or 10    -- bypass unused types
    Return
Endif

If ( Digit_Type ≠ 2 (i.e., Minutes - Units) .AND.
     Previous Digit_Type has not been Validated )
    Return
Endif
```

```
Get Zero_Index, Rollover_Time, Start_Ptr, and End_Ptr values
from Parameter DataStructure for current value of Digit_Type

PutScore = address of Digit Verifying Array for Digit_Type


--- MAIN LOOP: Process all Data between Start_Ptr and
---            End_Ptr

DO FOR PTR = Start_Ptr to End_Ptr

    --  Adjust Zero_Index, if necessary

    If Rollover_Time_Max ≠ 0  .AND. Digit_Type ≠ 8
        Rollover_Time = Rollover_Time - 1
        If Rollover_Time = 0
            Rollover_Time = Rollover_Time_Max
            Zero_Index = Zero_Index - 1  MODULO #Values

            --  Special Handling for Hundred Days Digit

            If Digit_Type = 6
               Decrement Rollover_Time(Digit_Type = 8)
               If Rollover_Time(Digit_Type = 8) = 0
                  Decrement Zero_Index(Digit_Type = 8) Mod 4
                  Rollover_Time(Digit_Type = 8) = 100
               Endif
            Endif
        Endif
    Endif

    --  At beginning of each day after day 364,
    --  call NEWYEAR_CHECK routine, which determines when
    --  the New Year begins (including leap year), and
    --  accordingly adjusts Rollover and ZeroIndex values
    --  for the three DAYS digit verification arrays.
    --  Note: HOUR and MINUTE values are maintained by
    --  Heartbeat interrupt routine - see Appendix 1.

    If (D_100 = 3 .AND. D_10 = 6 .AND. D_1 > 4 .AND.
    HOUR = 00 .AND. MINUTE = 00 )
        CALL NEWYEAR_CHECK
    Endif
--  Perform Scoring for Data at PTR

    RawData = data in HistoryBuffer at PTR
    Do For Value = 0 to #Values
        SCORE = number of 0 and 1 bits consistent with Value
        Store SCORE in PutScore Verifying Array
            at (ZeroIndex + Value) Modulo #Values
    EndDo

EndDo                          ----  END OF MAIN LOOP  ----

Start_Ptr = End_Ptr = End_Ptr + 1 Modulo (HistoryBufferSize)
```

```
--  Variable Threshold helps provide noise immunity

Threshold = value from Threshold table, selected in accor-
            dance with the amount of time, CNT_1, since the
            beginning of the current data verification cycle
            (i.e., the amount of time the system has been
            trying to verify all digits)

Δ = Maximum Score in PutScore - Next Highest Score

If Δ ≥ Threshold
    Value of this Digit =
        (Value with Max Score - ZeroIndex) Modulo #Values
    Validated(Digit_Type) = .T.
Else
    Validated(Digit_Type) = .F.      -- Flag for noting when
Endif                                -- digit has been
                                     -- validated
If All Validated() = .T.
    Lockon = .T.              -- Flag for noting when all
                              -- digits have been validated
    Time_Available = .T.      -- Output Timebase available

    Verify_Mode = On_Line     -- On_Line means that digits
                              -- data is decoded every
                              -- five seconds
Else
    Lockon = .F.
    If Validated(3)                -- If M_1 has been validated
        Verify_Mode = Off_Line     -- Off_Line means that the
    Endif                          -- system will try to verify
Endif                              -- a new digit every second
                                   -- until all digits have
                                   -- been verified.
If Validated(11)  -- Prepare for Change in Daylight Savings

    Decrement both Putscore values for Daylight Savings Bit
    equally until the Maximum score is 3, but set the other
    score to 0 if it is decremented below zero.
Endif

Return
```

FIRST EXAMPLE OF DIGIT VERIFICATION

RAW DATA FOR D_10

SCORING VALUES FOR D_10 DIGIT VERIFICATION ( * denotes corrupted data )

| d d d d<br>1 2 4 8 | value: 0 | 1 | 2 | 3 | 4 | 5 | 6 | 7 | 8 | 9 |
|---|---|---|---|---|---|---|---|---|---|---|
| 0 4 0 0<br>* | 3 | 2 | 3 | 2 | 2 | 1 | 2 | 1 | 2 | 1 |

Zero_Index = 0
Δ = 0

0 0 0 4
* *

| + 3 | 2 | 2 | 1 | 2 | 1 | 1 | 0 | 3 | 2 |
|---|---|---|---|---|---|---|---|---|---|
| 6 | 4 | 5 | 3 | 4 | 2 | 3 | 1 | 5 | 3 |

Zero_Index = 0
$\Delta = \overline{1}$ 0 1 0 0

| + 3 | 2 | 4 | 3 | 2 | 1 | 3 | 2 | 2 | 1 |
|---|---|---|---|---|---|---|---|---|---|
| 9 | 6 | 9 | 6 | 6 | 3 | 6 | 3 | 7 | 4 |

Zero_Index = 0
$\Delta = \overline{0}$ 4 1 0 0
*

| + 2 | 2 | 3 | 3 | 1 | 1 | 2 | 2 | 1 | 1 |
|---|---|---|---|---|---|---|---|---|---|
| 11 | 8 | 12 | 9 | 7 | 4 | 8 | 5 | 8 | 5 |

Zero_Index = 0
$\Delta = \overline{1}$ 0 1 0 0

| + 3 | 2 | 4 | 3 | 2 | 1 | 3 | 2 | 2 | 1 |
|---|---|---|---|---|---|---|---|---|---|
| 14 | 10 | 16 | 12 | 9 | 5 | 11 | 7 | 10 | 6 |

Zero_Index = 0
$\Delta = \overline{2}$
If Threshold ≤ 2, Result is
D_10 = (Value with Max_Score - ZeroIndex) Modulo #Values
= (2 - 0) Modulo $\overline{10}$ = 2

0 1 0 4
*

| + 2 | 1 | 3 | 2 | 1 | 0 | 2 | 1 | 2 | 1 |
|---|---|---|---|---|---|---|---|---|---|
| 16 | 11 | 19 | 14 | 10 | 5 | 13 | 8 | 12 | 7 |

Zero_Index = 0
$\Delta = \overline{3}$
If Threshold ≤ 3, Result is
D_10 = (Value with Max_Score - ZeroIndex) Modulo #Values
= (2 - 0) Modulo $\overline{10}$ = 2

SECOND EXAMPLE OF DIGIT VERIFICATION

RAW DATA
FOR M_1
d d d d
1 2 4 8

SCORING VALUES FOR M_1 DIGIT VERIFICATION ( * denotes corrupted data )

| value: | 0 | 1 | 2 | 3 | 4 | 5 | 6 | 7 | 8 | 9 |
|---|---|---|---|---|---|---|---|---|---|---|
| 1 4 1 0 * | 1 | 2 | 1 | 2 | 2 | 3 | 2 | 3 | 0 | 1 |

Zero_Index = 0
$\Delta = \overline{0}$ 0 4 1 0
*

| + 1 | 2 | 1 | 3 | 2 | 3 | 2 | 1 | 0 | 2 |
|---|---|---|---|---|---|---|---|---|---|
| 2 | 4 | 2 | 5 | 4 | 6 | 4 | 4 | 0 | 3 |

Zero_Index = 9
$\Delta = \overline{1}$ 1 1 1 4
*

| + 1 | 2 | 1 | 2 | 2 | 3 | 0 | 1 | 0 | 1 |
|---|---|---|---|---|---|---|---|---|---|
| 3 | 6 | 3 | 7 | 6 | 9 | 4 | 5 | 0 | 4 |

Zero_Index = 8
$\Delta = \overline{2}$
If Threshold = 2, Result is
M_1 = (Value with Max_Score - ZeroIndex) Modulo #Values
= (5 - 8) Modulo $\overline{10}$
= -3 Modulo 10
= 7

0 0 0 4
*

| + 1 | 2 | 1 | 1 | 0 | 3 | 2 | 3 | 2 | 2 |
|---|---|---|---|---|---|---|---|---|---|
| 4 | 8 | 4 | 8 | 6 | 12 | 6 | 8 | 2 | 6 |

Zero_Index = 7
$\Delta = \overline{4}$
If Threshold ≤ 4, Result is
M_1 = (Value with Max_Score - ZeroIndex) Modulo #Values
= (5 - 7) Modulo $\overline{10}$ = -2 Modulo 10 = 8

1 0 0 1

| + 1 | 2 | 0 | 1 | 3 | 4 | 2 | 3 | 1 | 2 |
|---|---|---|---|---|---|---|---|---|---|
| 5 | 10 | 4 | 9 | 9 | 16 | 8 | 11 | 3 | 8 |

Zero_Index = 6
$\Delta = \overline{5}$
M_1 = (5 - 6) Modulo 10 = -1 Modulo 10 = 9

APPENDIX 5

PSEUDOCODE FOR TICK_ADJUST ROUTINE

```
-- Calculate deviation of the observed one second boundary
-- (using the 1000 or 1200 Hz tick) from the current one
-- second boundary.  The deviation is measured in units of
-- CPU cycles, with 1536 (600 HEX) CPU cycles in each
-- millisecond.

--  TICK_LOCATION ARRAY - for 12 consecutive Ticks
--
--  1   2   3   4   5   6   7   8   9  10  11  12
--
--  |   |   |   |   |   |   |   |   |   |   |   |
--
```

```
--    TICK_TYPE    is frequency of tick signal = 1000 or 1200

--    LONG_DRIFT   is the average clock drift during the
--                 recent past, calculated by AVERAGE_ADJUST

--   Method used: Use current tick location data for
--   adjustment only if
--    (1)  there are 4 ticks in TICK_LOCATION array which are
--         consistent with one another to within 1.05
--         milliseconds ( 1613 CPU cycles )
--    AND
--    (2)  these four ticks vary from the current one second
--         boundary by less than 8 milliseconds
--         ( 12288 CPU cycles )
--
--    OTHERWISE: use average drift value from long term
--    clock drift routine.

If (TICK_LOCATION contains four ticks meeting tests 1 and 2)
     ADJUST = average of these four ticks
     GoodTick_Flag = .T.
     BadTick_Cycles = 0
Else
     ADJUST = LONG_DRIFT
     GoodTick_Flag = .F.
     Increment BadTick_Cycles
Endif

--    AVERAGE_ADJUST routine keeps track of average clock
--    drift in the recent past (e.g., during the last day)
--    and provides an updated LONG_DRIFT value whenever
--    new good tick data is found by the TICK_ADJUST routine.
--    See Appendix 6.

Call AVERAGE_ADJUST (ADJUST, TICK_TYPE, GoodTick_Flag)
If ADJUST > 0
     Set ClockRate = 1537     -- slow down from normal
     ADJUSTflag = .T.         -- rate
ElseIf ADJUST < 0
     Set ClockRate = 1535     -- speed up from normal rate
     ADJUST = 0 - ADJUST      -- made ADJUST positive
     ADJUSTflag = .T.         --
Endif

Return
```

APPENDIX 6

PSEUDOCODE FOR AVERAGE_ADJUST ROUTINE

```
--    The AVERAGE_ADJUST routine keeps track of average clock
--    drift in the recent past (e.g., during the last day)
--    and provides an updated LONG_DRIFT value whenever
--    new good tick data is found by the TICK_ADJUST routine.
```

```
--   Calling Format:
--   Call AVERAGE_ADJUST (ADJUST, TICK_TYPE, GoodTick_Flag)

--   ADJUST is most recent adjustment used by TICK_ADJUST

--   GoodTick_Flag indicates if ADJUST value was calculated
--   by TICK_ADJUST, or merely represents a copy of
--   LONG_DRIFT

--   TICK_TYPE  is frequency of tick signal = 1000 or 1200

--   LONG_DRIFT is the average clock drift during the recent
--              past, as calculated by AVERAGE_ADJUST


--              AVERAGE DRIFT TRACKING ARRAY

--    1000 HZ:  Current Values     Successor Values

--
--
--

--    1200 HZ:  Current Values     Successor Values

--
--
--

--  length of      | Total       | length of      | Total
--  time included  | Adjustment  | time included  | Adjustment
--  in average     | Value       | in average     | Value
--   Calculate a new LONG_ADJUST value only if GoodTick_Flag
--   is TRUE, and the drift has been track for at least
--   one hour

If TICK_TYPE = 1000
     Increment both Time values in TRACK_1000
     Add ADJUST to both Total value in TRACK_1000
     Add ADJUST to each Total value in TRACK_1200 that
          already has a nonzero value, and increment the
          corresponding Time values in TRACK_1200
     If GoodTick_Flag and TRACK_1000.CurrentTime ≥ 60
          LONG_ADJUST =
            TRACK_1000.CurrentTotal / TRACK_1000.CurrentTime
     Endif
Else
     Increment both Time values in TRACK_1200
     Add ADJUST to both Total value in TRACK_1200
     Add ADJUST to each Total value in TRACK_1000 that
          already has a nonzero value, and increment the
          corresponding Time values in TRACK_1000
     If GoodTick_Flag and TRACK_1200.CurrentTime ≥ 60
          LONG_ADJUST =
            TRACK_1200.CurrentTotal / TRACK_1200.CurrentTime
     Endif
Endif
```

```
--   At specified times, copy Successor Values in Average
--   Drift Tracking Array into Current Values in the Array,
--   and clear the Successor Values. In this way the Current
--   Values represent the sum of the current clock drift
--   values and those of the most recent previous period.

If (Current Decoded Time is one of the specified times, such
     as noon and midnight, or 6 a.m. and 6 p.m., or all four
     of these times)

     Copy_Flag = .T.
Endif

If Copy_Flag .AND. GoodTick_Flag
     Copy Successor Values (for both 1000 and 1200 Hz)
          into Current Values
     Clear Successor Values
     Copy_Flag = .F.
Endif

Return
```

APPENDIX 7

PSEUDOCODE FOR SEARCH_FREQ ROUTINE

```
--  Purpose: to find a carrier frequency, and a tick
--  frequency (1000 Hz or 1200 Hz).

--  Procedure: Select a carrier frequency from the list of
--  available frequencies.  Then, looking only at 100 HZ,
--  determine if signal is reasonably decodeable.  If so,
--  select a tick frequency and fine tune the internal
--  clock's one second boundary.

--  If the selected carrier does not yield a reasonably
--  decodeable 100 Hz signal, try the next carrier frequency
--  in the list of available frequencies.

--      LIST OF CARRIER FREQUENCIES
--
--  | 2.5 MHz | 5.0 MHz | 10.0 MHz | 15.0 MHz | 20.0 MHz |
--
--              ↑
--            NextFreq

-- BUCKET_100HZ: INTEGRATION BUFFER FOR FREQUENCY SELECTION
--
--   0   1   2   3   4   5   6   7        98  99
--
--  | 0 | 0 | 3 | 4 | 4 | 3 | 3 | 4 |  | 0 | 0 |
--

--  Clear Digit Verification Arrays      -  See Appendix 4
```

```
Clear Bit Buffer

Clear History Buffer

Clear Digit Verification Scoring Arrays for M_1, M_10,
Hours, D_1, D_10, D_100, and DayLightSavings

Set all StartPtr and EndPtr values to 1 (first minute in
History Buffer)

Set all ZeroIndex values to 0

Set all Validated(Digit_Type) values to .F.

BadTick_Cycles = BadBit_Cycles = 0

Minute_Framed = Minute_Faded = Lockon = .F.
Store 40 hex in all sixty slots of the Minute Framing Buffer
--  Calculate initial "quality" scores for all available
--  carrier frequencies

Set Subchannel Tuner to 100 HZ
Do for all available carrier frequencies
  Set Input Tuner to Next Available Carrier Frequency
  Do for J = 1 to 4
     Do for I = 0 to 99
        Wait until CNT_MAIN = 10 * (I + 1)
        Bucket_100HZ(I) = Bucket_100HZ + Store_100HZ_Cycles
        Store_100HZ_Cycles  = 0
     EndDo
  EndDo
  Score for this frequency = correlation between
     BUCKET_100HZ data and a square rising edge
EndDo

Reorder the List of Available Carrier Frequencies, putting
those with the highest scores at the beginning of the List


----  Main Search Loop: Loop until a good frequency is found

GoodFreq = .F.
N_Pass   = 0                -- Number of passes through all
                            -- available carrier frequencies
DO UNTIL GoodFreq

  Increment N_Pass
  NextFreq = top item in List of Available Frequencies

  Do for all available carrier frequencies,
  while .NOT. GoodFreq
     Set Input Tuner to NextFreq
     Increment NextFreq pointer Modulo 5
     Set Subchannel Tuner to 100 HZ

--  Collect 100 HZ data for 4*N_Pass seconds (but not more
--   than 16 seconds), for each ten millisecond bucket
```

```
--    in Bucket_100HZ buffer

      Wait Until CNT_MAIN = 0
      Store_100HZ_Cycles  = 0

      Do for J = 1 to Min(16, 4*N_Pass)
        Do for I = 0 to 99
           Wait until CNT_MAIN = 10 * (I + 1)
           Bucket_100HZ(I) = Bucket_100HZ +
                                Store_100HZ_Cycles
           Store_100HZ_Cycles  = 0
        EndDo
      EndDo
---- SEARCH_FREQ ROUTINE, Appendix 7, continued

--  Check quality of 100 HZ signal:

     Score = correlation of BUCKET_100HZ data with square
               rising edge

     If Score < Predefined Minimum Score for
                   good rising edge
        LOOP                -- I.e., jump to end of main loop
                            -- and try next frequency
     Endif

     ZeroLctn = 10 * ( Index for bucket in Bucket_100Hz
                            with rising edge )
                  - 30                -- 30 millisecond offset
                                      -- see Figure 1

--  Try to Fine Tune location of one second boundary

--  BUCKET_1000HZ:
--  128 BUCKET INTEGRATION BUFFER FOR FINE TUNING CLOCK
--
--   1   2          62  63  64  65  66  67  68  69          128
--
--  | 0 | 0 |  |  | 0 | 10 | 9 | 10 | 9 | 9 | 1 | 0 |  |  | 0 |
--
                                  | ← Original estimate
                                      of 1 second boundary
                          | ← New setting for boundary

--  Collect 1000 / 1200 HZ data for 10 seconds, for each
--  one millisecond bucket in Bucket_1000HZ buffer

    Clear Bucket_1000HZ (1 to 128) buffer
    StartTime = ZeroLctn - 65

    Do for K = 1000 to 1200 by 200        -- Tick Freq index
        Set Subchannel Tuner to K
        Do for J = 1 to 10                -- Seconds index

            Wait until CNT MAIN = StartTime
```

```
        Store_100HZ_Cycles  = 0
        Do for I = 1 to 128          -- Millisec index

            Wait until CNT_MAIN = StartTime + I
            If Store_100HZ_Cycles ≥ 1
                Increment Bucket_100HZ(I)
            Endif
            Store_100HZ_Cycles  = 0
        EndDo
    EndDo
--  Check quality of 1000 / 1200 HZ signal:

        If (Bucket_1000HZ contains at least 4, but less than
            6 buckets with a value greater than 6)

            TICK_TYPE = K        --  Selected Tick Frequency

            ZeroLctn = Index for 1st bucket in Bucket_1000Hz
                        with a value greater than 5 )

            GoodFreq = .T.       --  Search Completed

            If .NOT. Sync_Flag (i.e., if the internal clock
                has not previously been synchronized with
                the radio tick signal)

                --- Synchronize internal clock with Tick:

                CNT_MAIN = CNT_MAIN - ZeroLctn  Modulo 1000

                Sync_Flag = .T.

            Else              -- AVERAGE_ADJUST - See Appndx 6

                Call AVERAGE_ADJUST (ZeroLctn * 1536,
                                     TICK_TYPE, .T.)
                        -- but don't increment time counters
            Endif

        Else
            GoodFreq = .F.       --  Try next Tick or Carrier
        Endif

    EndDo        --  End of 1000 / 1200 Tick Search Loop

  EndDo          ---  End of N_Pass through Frqncy List Loop

  Reorder List of Available Carrier Frequencies in
    accordance with calculated Score values

EndDo            ----  End of Frequency Search Loop


CNT_1 = 0    --  Reset the internal timer, CNT_1, used to
             --  vary the digit verification Threshold until
             --  all digits are verified.

Return
```

APPENDIX 8

PSEUDOCODE FOR MINUTE_FRAMING ROUTINE

```
--  This routine is called by the Main Routine only when the
--  Previous_Bitvalue was a Decade Marker.  Initially, after
--  the selection of a new frequency, this routine "frames
--  the minute boundary" of the data being received.  After
--  initial minute framing, this routine checks to see that
--  the initial minute framing was correct.

-------   The Minute Framing Buffer (MFB)

--
--      | 42 | 40 | 40 | 40 | 40 | 40 | 40 |    | 38 |    | 38 |    |    | 40 |
--
--        0    1    2    3    4    5    6        10       30 . . .      59

--      Bitvalue                                  MinuteValue
--      Decade Marker followed by:
--          No Pulse                                  + 1
--          Data Value of 0 or 1                      - 1
--          Any other values                            0

MV = MinuteValue for Current_Bitvalue
MFB(SEC) = max(0, MFB(SEC) + MV)
        -- SEC = internal seconds counter

If MV ≠ +1          --  Minute Framing Decisions are made only
    Return          --  when a Minute Marker is found
Endif


--  Limit Maximum Value in MFB to 80 hex

If MaxM ≥ 80 hex
    Divide all values in MFB() by 2
Endif

MaxM = Max(values in MFB)
M_Position = Position of MaxM in MFB
Max2 = Second_largest(values in MFB)
If .NOT.  MinuteFramed
   .AND.  SEC = M_Position  .AND.  MaxM - Max2 ≥ 2

    -- Minute Boundary Found

    Wait Until CNT_MAIN < 970    -- Make sure we're into
                                 -- next second

    -- Synchronize internal counter with Minute Boundary

    Shift MFB values by M_Position positions so that
    MFB(0) is the position for Minute Marker
```

```
    SEC  = S_1 = 1
    S_10 = 0

    --  Transfer all data in Bit Buffer into History
    --  Buffer using current value of SEC to determine
    --  placement of data

    Call HISTORY_VALUE

    --  Set Minute Framed Flag

    Minute_Framed = .T.      --  Ready to Start Normal Data
    Minute_Faded  = .F.      --  Processing by MAIN Routine

    --  Try to Verify M_1 Digit

    Digit_Type = 3
    Call DIGIT_VERIFY            --  See Appendix 4

Else        --  Check that Minute Boundary is still correct

    If SEC = 0       --  If Current Minute Marker is
        Return       --  at SEC = 0, no further checking
                     --  is necessary

    --  If Maximum Value in MFB is not at SEC = 0
    --  of if the second largest value in the MFB
    --  is equal to the largest value,
    --  the minute boundary setting is not correct !

    Elseif MaxM = Max2  .OR.  M_Position ≠ 0
        Minute_Faded  = .T.
        Minute_Framed = .F.
    Endif
Endif

Return
```

APPENDIX 9

PSEUDOCODE FOR START_UP ROUTINE

```
--  Purpose:  Upon POWER UP, or system RESET, this routine
--  initiates the process of finding a carrier frequency,
--  and then decoding radio signal as soon as possible.

CALL SELF_TEST       --  the usual self diagnostic tests

--  Initialize internal clock  -  See Appendix 1

CNT_MAIN = S_1 = S_10 = MINUTE = HOUR = 0

Time_Available = .F.

Sync_Flag = .F.          --  CNT_MAIN has not yet been
                         --  synchronized with radio signal
```

```
-- See - Appendix 7

-- Clear Long Term Clock Drift Array  -  See Appendix 6

Clear TRACK_1000 and TRACK_1200 Time and Total values

Copy_Flag = .F.

-------  FIND CARRIER FREQUENCY      -  See Appendix 7

Call SEARCH_FREQ

-------  START MAIN ROUTINE          --  See Appendix 3

CALL MAIN        --  Data already in History Buffer will be
                 --  processed by Digit Verification Routine
                 --  when that routine is called by the
                 --  MAIN routine.
```

APPENDIX 10

PSEUDOCODE FOR LOCKON VERIFICATION ROUTINE

```
-- Purpose:  Whenever all the digits in the time signal
-- have been verified, check the values of these digits for
-- consistency with the previously verified digit values.

-- Replace OutputTimebase (i.e., replace the internal clock
-- counters corresponding to the verified digit values)
-- only when newly verified digits are consistent with
-- previously verified digit values.

GuessTimebase =  Digit Values determined by
                 Digit_Verify Routine

-- Clear Digit Verification Arrays -  See Appendix 4

Clear Bit Buffer

Clear History Buffer

Clear Digit Verification Scoring Arrays for M_1, M_10,
Hours, D_1, D_10, D_100, and DayLightSavings

Set all StartPtr and EndPtr values to 1 (first minute in
History Buffer)

Set all ZeroIndex values to 0

Set all Validated(Digit_Type) values to .F.
```

```
CNT_1 = 0

--  If this is first time we've had lockon, just increment
--  confidence level C_OUT of the output timebase to 1

If C_OUT = 0

    C_OUT = 1
    OutputTimebase = GuessTimebase
    LastLockon     = OutputTimebase
    Return
Endif
--  Check GuessTimebase for consistency with OutputTimebase

OutputTimebase = Current value of output timebase

Drift =  | OutputTimebase - GuessTimebase |
If Drift ≤ MaxDriftRate * (OutputTimebase - LastLockon)

    --  GuessTimebase agrees with OutputTimebase

    OutputTimebase = GuessTimebase
    LastLockon     = OutputTimebase
    C_OUT = Min(C_OUT + 1, Cmax)

--  If C_OUT - C_ALT > 2          -- Alternate Embodiment
--      C_ALT = C_ALT - 1         -- decrement C_Alt
--  Endif

    Return      -- No further processing needed
Endif

--  !! Newly decoded Timebase is not
--  consistent with OutputTimebase  !!

If C_ALT = 0                  --  First Alternate ?
    AlternateTimebase = GuessTimebase
    LastAlternate     = OutputTimebase
    C_ALT = 1
    Return
Endif

--  Check GuessTimebase for consistency with
--  AlternateTimebase

ΔT  =  OutputTimebase - LastAlternate

Drift =  | AlternateTimebase + ΔT - GuessTimebase |

If Drift ≤ MaxDriftRate * ΔT
    C_ALT = min(C_ALT + 1, Cmax)
    If C_ALT ≥ C_OUT

        --  Replace OutputTimebase with GuessTimebase
        OutputTimebase = GuessTimebase
```

```
        LastLockon      = OutputTimebase
        C_OUT = C_ALT
        C_ALT = 0
    Else
        Replace AlternateTimebase with GuessTimebase
        LastAlternate   = OutputTimebase
    Endif
    Return
Endif

--  GuessTimebase disagrees with both the OutputTimebase
--  and the AlternateTimebase

C_ALT = C_ALT - 1          -- decrease confidence in
                           -- AlternateTimebase

If C_ALT = 0

    AlternateTimebase = GuessTimebase
    LastAlternate     = OutputTimebase
    C_ALT = 1
Endif

Return


END                -- End of Pseudocode --
```

What is claimed is:

1. A radio signal controlled clock for keeping time in accordance with broadcast time-based radio signals, said clock comprising:

receiver means for receiving broadcast time-based radio signals at a specified carrier frequency, said radio signals containing encoded time information including a multiplicity of binary coded digits representing the current time;

processing means coupled to said receiver means for decoding the time information contained in said time-based radio signal, including:

data collecting means for decoding and storing the binary bits encoded in said tie-based radio signal; and digit verification means for determining the digit values represented by said decoded binary bits, including scoring means for each of a multiplicity of said digits for scoring each potential value of said digit in accordance with the number of said decoded bits which are consistent with said potential value, and verifying means for verifying one of said potential digit values as the correct value when the score for said one potential digit value exceeds the scores for all of the other potential digit values by at least a specified threshold value;

and output means for generating a verified time signal corresponding to digit values verifying by said verifying means.

2. A radio signal controlled clock as set forth in claim 1, wherein said encoded time information in said time-based radio signals includes clock reference signals for demarking a predefined time period;

said processing means including:

oscillator means for generating a periodic signal;

internal counter means for keeping track of the passage of time in accordance with said periodic signal generated by said oscillator means;

means for synchronizing said internal counter means with said clock reference signals, and for determining the amount said internal counter is adjusted each time said internal counter is synchronized with said clock reference signals;

and means for accumulating said adjustment amounts, and for determining the average adjustment made over a period of time;

said means for synchronizing further including means for periodically adjusting said internal counter in accordance with said average adjustment when said clock reference signals are not received by said receiver and whenever said clock reference signals are otherwise not available to said means for synchronizing;

whereby said internal counter means can be kept approximately synchronized with said clock reference signals even when said clock reference signals are not available.

3. A radio controlled clock as set forth in claim 1, wherein said encoded time information in said time-based radio signals is arranged in accordance with a predefined format and includes marker information usable for determining the relative locations of said binary bits in said predefined format;

said data collecting means includes means for decoding and storing said binary bits while also decoding the marker information in said time-based radio signals and thereby determining the relative locations of said encoded bits in said predefined format;

said digit verification means includes means for using said binary bits decoded and stored by said data collecting means while decoding said marker information to determine the relative locations of said bits in said predefined format;

whereby said clock can collect data usable for digit verification even before decoding said marker information to determine the relative locations of said encoded bits in said predetermined format.

4. A radio signal controlled clock for keeping time in accordance with broadcast time-based radio signals containing encoded time information in accordance with a predefined format, said time information including clock reference signals for demarking a predefined time period; said clock comprising:

receiver means for receiving broadcast time-based radio signals at a specified carrier frequency;

processing means coupled to said receiver means for decoding the time information contained in said time-based radio signals, including:

oscillator means for generating a periodic signal;

internal counter means for keeping track of the passage of time in accordance with said periodic signal generated by said oscillator means;

means for synchronizing said internal counter means with said clock reference signals, and for determining the amount said internal counter is adjusted each time said internal counter is synchronized with said clock reference signals;

means for accumulating said adjustment amounts, and for determining the average adjustment made over a period of time;

said means for synchronizing further including means for periodically adjusting said internal counter in accordance with said average adjustment when said clock reference signals are not received by said receiver and whenever said clock reference signals are otherwise not available to said means for synchronizing;

whereby said internal counter means can be kept approximately synchronized with said clock reference signals even when said clock reference signals are not available.

5. A radio signal controlled clock for keeping time in accordance with broadcast time-based radio signals containing encoded time information in accordance with a predefined format, said time information including a multiplicity of binary coded digits representing the current time and marker information usable for determining the relative locations of said binary bits in said predefined format; said clock comprising:

receiver means for receiving broadcast time-based radio signals at a specified carrier frequency;

control means coupled to said receiver means for specifying the carrier frequency to be received by said receiver means, and for decoding the time information contained in said time-based radio signal, including:

data collecting means for decoding and storing the binary bits encoded in said time-based radio signal, including means for decoding and storing said binary bits while also decoding the marker information in said time-based radio signals and thereby determining the relative locations of said encoded bits in said predefined format; and time information decoding means for generating a decoded time value by determining the values of said multiplicity of binary coded digits representing the current time using said decoded binary bits stored by said data collecting means, including means for using said binary bits decoded and stored while decoding said marker information to determine the relative locations of said bits in said predefined format;

and output means for generating a time signal corresponding to said decoded time value;

whereby said clock can collect data usable for time decoding even before decoding said marker information to determine the relative locations of said encoded bits in said predefined format.

6. A radio signal controlled clock for keeping time in accordance with broadcast time-based radio signals containing encoded time information in accordance with a predefined format, aid time information including a multiplicity of binary coded digits representing the current time and clock reference signals for demarking a predefined time period, said digits being encoded as a series of binary bits pulse width encoded using a first subchannel frequency of the broadcast radio signals, and said clock reference signals being encoded using a second subchannel frequency of the broadcast radio signals; said first subchannel frequency of the broadcast radio signals further including marker information usable for determining the relative locations of said encoded bits in said predefined format; said clock comprising:

receiver means for receiving broadcast time-based radio signals at a specified carrier frequency;

subchannel filter means coupled to said receiver means for selectively passing a specified frequency subchannel of the output signal generated by said receiver means;

control means for specifying the carrier frequency to be received by said receiver means, specifying the subchannel to be passed by said subchannel filter means, and for decoding the time information contained in the output of said subchannel filter means, including:

startup means for selecting a carrier frequency and for selecting said first subchannel frequency;

frequency evaluation means for evaluating whether the output of said subchannel filter means contains decodeable pulse width encoded bits;

data collecting means for decoding and storing the binary bits encoded in the output of said subchannel filter means, including means for decoding and storing said binary bits while also decoding the marker information in said first subchannel frequency to determine the relative locations of said encoded bits in said predefined format;

time information decoding means for generating a decoded time value by determining the values of said multiplicity of binary coded digits representing the current time using said decoded binary bits stored by said data collecting means, including means for using said binary bits decoded and stored while decoding said marker information to determine the relative locations of said bits in said predefined format;

and output means for generating a time signal corresponding to said decoded time value.

7. A radio signal controlled clock as set forth in claim 6, wherein said control means includes:

oscillator means for generating a periodic signal;

internal counter means for keeping track of the passage of time in accordance with said periodic signal generated by said oscillator means;

means for synchronizing said internal counter means with said clock reference signals, and for determining the amount said internal counter is adjusted each time said internal counter is synchronized with said clock reference signals;

and means for accumulating said adjustment amounts, and for determining the average adjustment made over a period of time;

said means for synchronizing further including means for periodically adjusting said internal counter in accordance with said average adjustment when said clock reference signals are not received by said receiver and whenever said clock reference signals are otherwise not available to said means for synchronizing;

whereby said internal counter means can be kept approximately synchronized with said clock reference signals even when said clock reference signals are not available.

8. A method of keeping time in accordance with broadcast time-based radio signals containing encoded time information in accordance with a predefined format, said time information including a multiplicity of binary coded digits representing the current time; the steps of the method comprising:

receiving broadcast time-based radio signals at a specified carrier frequency;

decoding the time information contained in said time-based radio signal, by decoding and storing the binary bits encoded in said time-based radio signal, and determining the digit values represented by said decoded binary bits;

said decoding step including the steps of separately verifying the correctness of each of a multiplicity of said digits by scoring each potential value of each said digit in accordance with the number of said decoded bits which are consistent with said potential value, and verifying one of said potential digit values as the correct value when the score for said one potential digit value exceeds the scores for all of the other potential digit values by at least a specified threshold value;

and generating a time signal corresponding to said verified digit values.

9. The method of claim 8, wherein said encoded time information in said time-based radio signals includes clock reference signals for demarking a predefined time period; said method further including the steps of:

generating a periodic signal;

generating an internal count value for keeping track of the passage of time in accordance with said periodic signal;

when said clock reference signals are available, synchronizing said internal counter means with said clock reference signals, and determining the amount said internal count value is adjusted each time said internal count value is synchronized with said clock reference signals;

accumulating said adjustment amounts, and determining the average adjustment made over a period of time;

periodically adjusting said internal count value in accordance with said average adjustment when said clock reference signals are not available;

whereby said internal count value can be kept approximately synchronized with said clock reference signals even when said clock reference signals are not available.

10. A radio signal controlled clock as set forth in claim 5, said time information decoding means including:

digit verification means for determining the digit values represented by said decoded binary bits, including scoring mans for each of a multiplicity of said digits for scoring each potential value of said digit in accordance with the number of said decoded bits which are consistent with said potential value, and verifying means for verifying one of said potential digit value as the correct value when the score for said one potential digit value exceeds the scores for all of the other potential digit values by at least a specified threshold value.

11. A radio signal controlled clock as set forth in claim 1, wherein said decoded digit values generated by said digit verification means comprise a verified time value, and said processing means includes lockon verifying means for selecting an output timebase value, including first timebase means for storing a first timebase value and a first confidence value corresponding to the reliability of said first time base value, said first timebase value comprising the selected output timebase value;

second timebase means for storing a second timebase value and a second confidence value corresponding to the reliability of said second timebase value;

timebase updating means for updating said first and second timebase values, including:

timebase value updating means for storing the verified time value generated by said digit verification means in said first timebase means when said decoded time value is not inconsistent with said first timebase value, if any, and for storing said verified time value in said second timebase means when said decoded time value is inconsistent with said first timebase value and not inconsistent with said second timebase value, if any;

confidence updating means for (a) increasing said first confidence value relative to said second confidence value when said decoded time value is not inconsistent with said first timebase value, and (b) increasing said second confidence value relative to sad first confidence value when said decoded time value is inconsistent with said first timebase value and not inconsistent with said second timebase value; and output timebase replacing means for replacing the timebase stored in said first timebase means with the timebase stored in said second timebase means when said second confidence value exceeds said first confidence level;

and said output means generates a time signal corresponding to said selected output timebase.

12. A radio signal controlled clock as set forth in claim 11, said confidence updating means including means for decreasing said first confidence value when said verified time value is inconsistent with said first timebase value and not inconsistent with said second timebase value.

13. A radio signal controlled clock as set forth in claim 11, said timebase value updating means including means for clearing said second timebase value and second confidence value stored by said second timebase means when said second confidence value exceeds said first confidence level;

said timebase value updating means for storing said verified time value in said second timebase means when said verified time value is inconsistent with said first timebase value and said second timebase value has been cleared.

14. A method of keeping time as set forth in claim 8, wherein said decoded digits generated by said decoding steps together comprise a verified time value, said method including locking onto a selected output timebase value, said locking step including the steps of:

storing a first timebase value and a first confidence value corresponding to the reliability of the said first timebase value, said first timebase value comprising the selected output timebase value;

storing a second timebase value and a second confidence value corresponding to the reliability of said second timebase value;

updating said first and second timebase values by:

replacing said first time value with said verified time value when said verified time value is not inconsistent with said first timebase value currently stored in said first timebase, if any, and replacing said second timebase value with said verified time value when said verified time value is inconsistent with said first timebase value and not inconsistent with said second timebase value, if any;

increasing said first confidence value relative to said second confidence value when said verified time value is not inconsistent with said first timebase value, and increasing said second confidence value relative to said first confidence value when said verified time value is inconsistent with said first timebase value and not inconsistent with said second timebase value; and replacing said first timebase value with said second timebase value when said second confidence value exceeds said first confidence level;

and outputting an output timebase value corresponding to said first timebase value.

15. A method of keeping time as set forth in claim 14, said step of increasing said second confidence value including the step of decreasing said first confidence value when said verified time value is inconsistent with said first timebase value and not inconsistent with said second timebase value.

16. A method of keeping time as set forth in claim 14, said step of replacing said first timebase value with said second timebase value including the step of clearing said second timebase value and second confidence value when said second confidence value exceeds said first confidence level;

said method including the step of storing said verified time value as said second timebase value when said verified time value is inconsistent with said first timebase value and said second timebase value has been cleared by said clearing step.

17. A radio signal controlled clock for keeping time in accordance with broadcast time-based radio signals, said clock comprising:

receiver means for receiving broadcast time-based radio signals at a specified carrier frequency, said radio signals containing encoded time information including a multiplicity of binary coded digits representing the current time;

data collecting means for decoding and storing the binary bits encoded in said time-based radio signal;

time information decoding means for generating a decoded time value by determining the values of said multiplicity of binary coded digits representing the current time using said decoded binary bits stored by said data collecting means, including digit verification means for verifying said decoded time value represented by said decoded binary bits and generating a verified time value;

lockon verifying means for selecting an output timebase value, including first timebase means for storing a first timebase value and a first confidence value corresponding to the reliability of said first timebase value, said first timebase value comprising the selected output timebase value;

second timebase means for storing a second timebase value and a second confidence value corresponding to the reliability of said second timebase value;

timebase updating means for updating the values of said first and second timebase means, including:

timebase value updating means for storing the verified time value generated by said digit verification means in said first timebase means when said decoded time value is not inconsistent with said first timebase value, if any, and for storing said verified time value in said second timebase means when said decoded time value is inconsistent with said first timebase value and not inconsistent with said second timebase value, if any;

confidence updating means for (a) increasing said first confidence value relative to said second confidence value when said decoded time value is not inconsistent with said first timebase value, and (b) increasing said second confidence value relative to said first confidence value when said decoded time value is inconsistent with aid first timebase value and not inconsistent with said second timebase value; and output timebase replacing means for replacing the timebase stored in said first timebase means with the timebase stored in said second timebase means when said second confidence value exceeds said first confidence level;

and output means for generating a time signal corresponding to said selected output timebase.

18. A radio signal controlled clock as set forth in claim 17, said confidence updating means including means for decreasing said first confidence value when said verified time value is inconsistent with said first timebase value and not inconsistent with said second timebase value.

19. A radio signal controlled clock as set forth in claim 17, said timebase value updating means including means for clearing said second timebase value and second confidence value stored by said second timebase means when said second confidence value exceeds said first confidence level;

said timebase value updating means for storing said verified time value in said second timebase means when said verified time value is inconsistent with said first timebase value and said second timebase value has been cleared.

20. A method of keeping time in accordance with broadcast time-based radio signals containing encoded time information in accordance with a predefined format, said time information including a multiplicity of binary coded digits representing the current time; the steps of the method comprising:

receiving broadcast time-based radio signals at a specified carrier frequency;

decoding and storing the binary bits encoded in said time-based radio signal;

generating a decoded time value by determining the values of said multiplicity of binary coded digits representing the current time using said decoded binary bits, verifying said decoded time value represented by said decoded binary bits, and generating a verified time value;

locking onto a selected output timebase value, said locking step including the steps of:

storing a first timebase value and a first confidence value corresponding to the reliability of the said first timebase value, said first timebase value comprising the selected output timebase value;

storing a second timebase value and a second confidence value corresponding to the reliability of said second timebase value;

updating said first and second timebase values by:

replacing aid first time value with said verified time value when said verified time value is not inconsistent with said first timebase value currently stored in said first timebase, if any, and replacing said second timebase value with said verified time value when said verified time value is inconsistent with said first timebase value and not inconsistent with said second timebase value, if any;

increasing said first confidence value relative to said second confidence value when said verified time value is not inconsistent with said first timebase value, and increasing said second confidence value relative to said first confidence value when said verified time value is inconsistent with said first timebase value and not inconsistent with said second timebase value; and replacing said first timebase value with said second timebase value when said second confidence value exceeds said first confidence level;

and outputing an output timebase value corresponding to said first timebase value.

21. A method of keeping time as set forth in claim 20, said step of replacing said first timebase value with said second timebase value including the step of clearing said second timebase value and second confidence value when said second confidence value exceeds said first confidence level;

said method including the step of storing said verified time value as said second timebase value when said verified time value is inconsistent with said first timebase value and said second timebase value has been cleared by said clearing step.

* * * * *